US010975671B2

(12) United States Patent
Bradley et al.

(10) Patent No.: US 10,975,671 B2
(45) **Date of Patent: *Apr. 13, 2021**

(54) BOX BY PIN PERFORATING GUN SYSTEM AND METHODS

(71) Applicant: Hunting Titan, Inc., Pampa, TX (US)

(72) Inventors: Richard Wayne Bradley, Pinehurst, TX (US); William Richard Collins, Burleson, TX (US); John W. Jordan, Sugar Land, TX (US); Andy Lane, Lubbock, TX (US); Dale Langford, Pampa, TX (US); Charles Levine, Waxahachie, TX (US); Faraidoon Pundole, Sugar Land, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/299,952

(22) Filed: Mar. 12, 2019

(65) Prior Publication Data

US 2019/0211655 A1 Jul. 11, 2019

Related U.S. Application Data

(63) Continuation of application No. 15/313,760, filed as application No. PCT/US2015/032222 on May 22, 2015, now Pat. No. 10,273,788.
(Continued)

(51) Int. Cl.
*E21B 43/1185* (2006.01)
*E21B 43/117* (2006.01)
(Continued)

(52) U.S. Cl.
CPC ..... *E21B 43/1185* (2013.01); *E21B 17/042* (2013.01); *E21B 43/117* (2013.01);
(Continued)

(58) Field of Classification Search
CPC ..... E21B 43/117; F42B 5/035
(Continued)

(56) References Cited

U.S. PATENT DOCUMENTS 2,216,359 A 10/1940 Spencer
2,598,651 A 5/1952 Spencer
(Continued)

FOREIGN PATENT DOCUMENTS

CA 2003166 A1 5/1991
CA 2824838 A1 2/2015
(Continued)

OTHER PUBLICATIONS

Dynaenergetics, Selective Perforating Switch, Product Information Sheet, May 27, 2011.
(Continued)

*Primary Examiner* — Taras P Bemko
(74) *Attorney, Agent, or Firm* — Jason Saunders; Christopher McKeon; Arnold & Saunders, LLP

(57) ABSTRACT

A method and system for a perforating gun having a box by pin perforating gun system using swaged down gun bodies. The box by pin perforating gun system may include a removable cartridge to hold a detonator with a switch and an insulated charge holder as an electrical feed-through.

22 Claims, 32 Drawing Sheets

Related U.S. Application Data

(60) Provisional application No. 62/002,565, filed on May 23, 2014, provisional application No. 62/002,559, filed on May 23, 2014, provisional application No. 62/015,030, filed on Jun. 20, 2014, provisional application No. 62/014,900, filed on Jun. 20, 2014, provisional application No. 62/015,014, filed on Jun. 25, 2014, provisional application No. 62/020,090, filed on Jul. 2, 2014, provisional application No. 62/112,935, filed on Feb. 6, 2015, provisional application No. 62/131,324, filed on Mar. 11, 2015.

(51) Int. Cl.
*E21B 17/042* (2006.01)
*F42D 1/04* (2006.01)
*F42B 3/08* (2006.01)
*F42B 5/03* (2006.01)

(52) U.S. Cl.
CPC ..... *F42B 3/08* (2013.01); *F42B 5/035* (2013.01); *F42D 1/043* (2013.01)

(58) Field of Classification Search
USPC ..... 175/2
See application file for complete search history.

(56) References Cited

U.S. PATENT DOCUMENTS

| | | | |
|---|---|---|---|
| 3,264,989 | A | 8/1966 | Rucker |
| 3,504,723 | A | 4/1970 | Cushman et al. |
| 4,100,978 | A | 7/1978 | Boop |
| 4,182,216 | A | 1/1980 | DeCaro |
| 4,208,966 | A | 6/1980 | Hart |
| 4,234,768 | A | 11/1980 | Boop |
| 4,261,263 | A | 4/1981 | Coultas et al. |
| 4,306,628 | A | 12/1981 | Adams, Jr. et al. |
| 4,574,892 | A | 3/1986 | Grigar et al. |
| 4,650,009 | A | 3/1987 | McClure et al. |
| 4,850,438 | A | 7/1989 | Regalbuto |
| 4,869,171 | A | 9/1989 | Abouav |
| 4,884,506 | A | 12/1989 | Guerreri |
| 4,967,048 | A | 10/1990 | Langston |
| 5,027,708 | A | 7/1991 | Gonzalez et al. |
| 5,038,682 | A | 8/1991 | Marsden |
| 5,060,573 | A | 10/1991 | Montgomery |
| 5,088,413 | A | 2/1992 | Huber et al. |
| 5,105,742 | A | 4/1992 | Sumner |
| 5,204,491 | A | 4/1993 | Aureal et al. |
| 5,347,929 | A | 9/1994 | Lerche et al. |
| 5,392,860 | A | 2/1995 | Ross |
| 5,436,791 | A | 7/1995 | Turano et al. |
| 5,503,077 | A | 4/1996 | Motley |
| 5,756,926 | A | 5/1998 | Bonbrake et al. |
| 5,859,383 | A | 1/1999 | Davison et al. |
| 6,085,659 | A | 7/2000 | Beukes et al. |
| 6,418,853 | B1 | 7/2002 | Duguet et al. |
| 6,557,636 | B2 | 5/2003 | Cernocky |
| 6,618,237 | B2 | 9/2003 | Eddy et al. |
| 7,193,527 | B2 | 3/2007 | Hall et al. |
| 7,347,278 | B2 | 3/2008 | Lerche et al. |
| 7,461,580 | B2 | 12/2008 | Bell et al. |
| 7,568,429 | B2 | 8/2009 | Hummel et al. |
| 7,762,172 | B2 | 7/2010 | Li et al. |
| 7,762,331 | B2 | 7/2010 | Goodman et al. |
| 7,778,006 | B2 | 8/2010 | Stewart et al. |
| 7,810,430 | B2 | 10/2010 | Chan et al. |
| 7,929,270 | B2 | 4/2011 | Hummel et al. |
| 7,934,453 | B2 | 5/2011 | Moore |
| 7,980,309 | B2 | 7/2011 | Crawford |
| 8,069,789 | B2 | 12/2011 | Hummel et al. |
| 8,074,737 | B2 | 12/2011 | Hill et al. |
| 8,157,022 | B2 | 4/2012 | Bertoja et al. |
| 8,182,212 | B2 | 5/2012 | Parcell |
| 8,256,337 | B2 | 9/2012 | Hill et al. |
| 8,395,878 | B2 | 3/2013 | Stewart et al. |
| 8,451,137 | B2 | 5/2013 | Bonavides et al. |
| 8,468,944 | B2 | 6/2013 | Givens et al. |
| 8,578,090 | B1 | 11/2013 | Jernigan, IV |
| 8,661,978 | B2 | 3/2014 | Backhus et al. |
| 8,689,868 | B2 | 4/2014 | Lerche et al. |
| 8,875,787 | B2 | 11/2014 | Tassaroli |
| 8,881,816 | B2 | 11/2014 | Glenn et al. |
| 8,884,778 | B2 | 11/2014 | Lerche et al. |
| 8,960,288 | B2 | 2/2015 | Sampson |
| 9,080,433 | B2 | 7/2015 | Lanclos et al. |
| 9,175,553 | B2 | 11/2015 | McCann et al. |
| 9,464,508 | B2 | 10/2016 | Lerche et al. |
| 9,494,021 | B2 | 11/2016 | Parks et al. |
| 9,581,422 | B2 | 2/2017 | Preiss et al. |
| 9,689,223 | B2 | 6/2017 | Schacherer et al. |
| 9,709,373 | B2 | 7/2017 | Hikone et al. |
| 2002/0020320 | A1 | 2/2002 | Lebaudy et al. |
| 2002/0062991 | A1 | 5/2002 | Farrant et al. |
| 2003/0000411 | A1 | 1/2003 | Cernocky et al. |
| 2003/0001753 | A1 | 1/2003 | Cernocky et al. |
| 2005/0178282 | A1 | 8/2005 | Brooks et al. |
| 2005/0229805 | A1 | 10/2005 | Myers, Jr. et al. |
| 2006/0027397 | A1 | 2/2006 | Scott |
| 2007/0084336 | A1 | 4/2007 | Neves |
| 2007/0158071 | A1 | 7/2007 | Mooney, Jr. et al. |
| 2008/0047456 | A1 | 2/2008 | Li et al. |
| 2008/0047716 | A1 | 2/2008 | McKee et al. |
| 2008/0173240 | A1 | 7/2008 | Anderson et al. |
| 2009/0050322 | A1 | 2/2009 | Hill et al. |
| 2009/0272519 | A1 | 11/2009 | Green et al. |
| 2010/0230104 | A1 | 9/2010 | Nolke et al. |
| 2011/0024116 | A1 | 2/2011 | McCann et al. |
| 2011/0042069 | A1 | 2/2011 | Bailey et al. |
| 2012/0199352 | A1 | 8/2012 | Lanclos et al. |
| 2012/0199031 | A1 | 9/2012 | Lanclos |
| 2012/0242135 | A1 | 9/2012 | Thomson et al. |
| 2012/0247771 | A1 | 10/2012 | Black et al. |
| 2012/0298361 | A1 | 11/2012 | Sampson |
| 2013/0118342 | A1 | 5/2013 | Tassaroli |
| 2013/0199843 | A1 | 8/2013 | Ross |
| 2014/0083718 | A1 | 3/2014 | Bell |
| 2014/0131035 | A1* | 5/2014 | Entchev ..... E21B 33/1204 166/255.1 |
| 2016/0084048 | A1 | 3/2016 | Harrigan et al. |
| 2016/0168961 | A1 | 6/2016 | Parks et al. |

FOREIGN PATENT DOCUMENTS

| | | | |
|---|---|---|---|
| CA | 2821506 | A1 | 1/2018 |
| EP | 0088516 | B1 | 5/1986 |
| EP | 0679859 | A2 | 11/1995 |
| EP | 0694157 | B1 | 8/2001 |
| EP | 2702349 | B1 | 11/2015 |
| GB | 2383236 | A | 6/2003 |
| WO | 2001059401 | A1 | 8/2001 |
| WO | 2009091422 | A2 | 7/2009 |
| WO | 2012106640 | A2 | 8/2012 |
| WO | 2012149584 | A1 | 11/2012 |
| WO | 2014046670 | A1 | 3/2014 |
| WO | 2015006869 | A1 | 1/2015 |

OTHER PUBLICATIONS

Dynaenergetics, Electronic Top Fire Detonator, Product Information Sheet, Jul. 30, 2013.

German Patent Office, Office Action dated May 22, 2014, in German: See Office Action for German Patent Application. No. 10 2013 109 227.6, which is in the same family as PCT Application No. PCT/EP2014/065752 (published as WO 2015/028204).

PCT Search Report and Written Opinion, dated May 4, 2015: See Search Report and Written opinion for PCT Application No. PCT/EP2014/065752.

Hunting Titan, Wireline Top Fire Detonator Systems, Product Information Sheet, date unknown, http://www.hunting-intl.com/titan/perforating-guns-and-setting-tools/wireline-top-tire-detonator-systems, 1 page.

(56) References Cited

OTHER PUBLICATIONS

Dynaenergetics, DYNAselect System, information downloaded from website, Jul. 3, 2013, http://www.dynaenergetics.com/.
Jim Gilliat/Khaled Gasmi, New Select-Fire System, Baker Hughes, Presentation—2013 Asia-Pacific Perforating Symposium, Apr. 29, 2013, http://www.perforators.org/presentations.php.
Dynaenergetics, DYNAselect Electronic Detonator 0015 SFDE ROX 1.4S, Product Information, Dec. 16, 2011.
Dynaenergetics, DYNAselect Electronic Detonator 0015 SFDE ROX 1.4B, Product Information, Dec. 16, 2011.
Dynaenergetics, Gun Assembly, Products Summary Sheet, May 7, 2004.
Dynaenergetics, Selective Perforating Switch, information downloaded from website, Jul. 3, 2013, http://www.dynaenergetics.com/.
Austin Powder Company, A-140 F Detonator and Block, 2 pages.
Corelab, RF-Safe Green Det, Side Block for side Initiation, Owen Oil Tools & Pacific Scientific Brochure, 1 page.
Jet Research Center, Pioneer of the Oilwell Shaped Charge Brochure, 2 pages.
Jet Research Center, Detonators, Detonating Cords, Explosive Components Catalog. www.jetresearch.com., 36 pages.
Horizontal Wireline Services, IPS-12-09-Presentation of a completion method of shale demonstrated through an example of the Marcellus Shale, Pennsylvania, USA, 17 pages.
Schlumberger, Dec. 22, 2012 European and West African Perforating Symposium, Selective Perforation a game changer in perforating technology case study, Norway, 14 pages.
Marathon Oil Co., Explosives Safety & Security Conference, Oil and Gas, 20 pages.
Schulumberger, MENAPS-11-15 Combining and Customizing Technologies for Perforating Horizontal Wells in Algeria, 20 pages.
Baker Hughes Incorporated, 2012 International Perforating Symposium, IPS-12-28 Long Gun Deployment Systems, Apr. 26 and Apr. 27 2011, The Woodlands, USA, 11 pages.
Owen Oil Tools, Update on API RP67: Recommended Practice for Oilfield Explosive Safety, 6 pages.
Baker Hughes Incorporated, New Select Fire System, Jim Gilliat, Khaled Gasmi, 16 pages.
Baker Hughes, SurePerf Rapid Select-Fire System Overview, 2 pages.
https://www.onepetro.org/conference-paper/SPE-119365-MS, Minimize Risk and Improve Efficiency Associated With Electric Coiled Tubing Perforating Operations—OnePetro, downloaded Jan. 30, 2018, 2 pages.
Onepetro, CEPSA SPE, Combining and Customizing Technologies for Perforating Horizontal Wells in Algeria, Jun. 2010, 2 pages.
Office action, Canadian application No. 2,933,756 dated Jan. 29, 2018, 4 pages.
Response to office action, Canadian application No. 2,933,756 dated May 29, 2018, 5 pages.
Office action, Canadian application No. 2,933,756 dated Jul. 31, 2018, 3 pages.
Response to Office action, Canadian application No. 2,933,756 dated Jan. 31, 2019, 14 pages.
Office action, Canadian application No. 3,010,967 dated Jul. 31, 2018, 4 pages.
Office action, U.S. Appl. No. 15/313,760 dated Apr. 17, 2018, 32 pages.
Response to Office action, U.S. Appl. No. 15/313,760 dated Oct. 17, 2018, 4 pages.
Office Action, Canadian application No. 2,933,756, dated May 25, 2017, 4 pages.
Response to Office Action, Canadian application No. 2,933,756, dated Nov. 23, 2017, 40 pages.
Notification concerning transmittal of international preliminary report on patentability, PCT Application No. PCT/US15/32222, dated Dec. 8, 2016, 14 pages.
Supplementary European Search Report, based on EP 15796416, dated Sep. 18, 2017, 6 pages.
Notification of Transmittal of the International Search Report and the Written Opinion of the International Searching Authority, PCT Application No. PCT/US15/32222, dated Oct. 28, 2015, 18 pages.
Supplementary European Search Report, based on EP 19200129.5, dated Jan. 21, 2019, 7 pages.
Canadian office action dated May 31, 2019, Canadian application No. 2,933,756, 4 pages.
Response to office action dated Oct. 30, 2019, Canadian application No. 2,933,756, 10 pages.
Canadian office action dated May 31, 2019, Divisional Canadian application No. 3,010,967, 4 pages.
Response to office action dated Oct. 29, 2019, Canadian application No. 3,010,967, 6 pages.
Supplementary European Search Report, based on Application No. EP 19200129.5, dated Jan. 21, 2020, 7 pages.
Supplementary European Search Report, based on Application No. EP 19200102.2, dated Jan. 21, 2020, 7 pages.

* cited by examiner

BOX BY PIN PERFORATING GUN SYSTEM AND METHODS

RELATED APPLICATIONS

This application is a continuation of U.S. application Ser. No. 15/313,760, filed Nov. 23, 2016, which is a 371 of international Application No. PCT/US15/32222, filed May 22, 2015, which claims priority to U.S. Provisional Application No. 62/002,565, filed May 23, 2014, U.S. Provisional Application No. 62/002,559, filed May 23, 2014, U.S. Provisional Application No. 62/015,030, filed Jun. 20, 2014, U.S. Provisional Application No. 62/014,900, filed Jun. 20, 2014, U.S. Provisional Application No. 62/015,014, filed Jun. 25, 2014, U.S. Provisional Application No. 62/020,090, filed Jul. 2, 2014, U.S. Provisional Application No. 62/112,935, filed Feb. 6, 2015, and U.S. Provisional Application No. 62/131,324, filed Mar. 11, 2015.

BACKGROUND

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, a detonator at one end of the perforating gun can detonate all of the perforating charges in the gun and continue a ballistic transfer to the opposite end of the gun. In this fashion, numerous perforating guns can be connected end to end with a single detonator detonating all of them.

The detonating cord is typically detonated by a detonator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Within a typical gun tube is a charge holder designed to hold the shaped charges. Charge holders can be formed as tubes, strips, or chains. The charge holder will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Currently, perforating guns are often assembled and loaded at a service company shop, transported to the well site, and then armed before they are deployed into a well. Sometimes perforating guns are assembled and armed at the well site. Because the service company shop often employs a single gun loader, maintaining close control on the gun assembly/loading procedures can become difficult. Accordingly, quality control on the assembled/loaded guns may be improved by reducing the amount of assembly necessary at the service company shop.

Many perforating guns are electrically activated. This requires electrical wiring to at least the firing head for the perforating gun. In many cases, perforating guns are run into the well in strings where guns are activated either singly or in groups, often separate from the activation of other tools in the string, such as setting tools. In these cases, electrical communication must be able to pass through one perforating gun to other tools in the string. Typically, this involves threading at least one wire through the interior of the perforating gun and using the gun body as a ground wire.

When typical a perforating gun is assembled/loaded either at the well site or at a service company shop, there is risk of incorrect assembly or damage to electrical wiring or other components that may cause the perforating gun or other tools to fail to fire or fail to function appropriately. For example, the threading of a pass-through wire through the gun body or charge holder presents numerous opportunities for the insulation of the wire to be stripped on sharp metal edges resulting in shorts in the communications circuit. Accordingly, there is a need for a system that eliminates the need to run a wire through a perforating gun body.

Typically, perforating guns and other tools are connected to each other electrically at the well site. This requires that a worker bring the guns or tools close together and then manually make a connection with one or more wires. This requires time and manpower at the well site and introduces the possibility of injury or assembly error. Accordingly, there is a need for a system that eliminates the requirement for workers to make wire connections between perforating guns or tools at the well site.

As discussed above, perforating guns and other tools are often connected with subs that also house related electronic and/or ballistic components. In order to eliminate these subs, a system is needed to house these electrical and ballistic components inside of perforating guns or other tools in an interchangeable and modular way. Additionally, current perforating guns typically have the same diameter and female threads on both ends. In order to eliminate the subs, a perforating gun system that provides male threads on one end of the gun and female threads on the other is needed.

SUMMARY OF EXAMPLES OF THE INVENTION

One embodiment to enable thin-walled perforating guns to be threaded directly together is a gun body that is swaged down to a smaller diameter on one end than the other. The smaller diameter end of the gun has male threads that are adapted to engage corresponding female threads on the larger end of a second perforating gun that has substantially the same outer diameter.

Another embodiment to enable thin-walled perforating guns to be threaded directly together is to use certain premium thread configurations that provide sufficient tensile strength in the joint despite relatively shallow thread depth. In this embodiment, both ends of the gun body have substantially the same outer diameter before machining to cut the threads. Male threads are placed on one end of the gun that are adapted to engage corresponding female threads on the other end.

Another embodiment to enable thin-walled perforating guns to be threaded directly together is a fitting welded onto one end of the gun body where the fitting has male threads that are adapted to engage corresponding female threads on the larger end of a second perforating gun that has substantially the same outer diameter.

One embodiment to enable electrical communication through a perforating gun without passing a wire though the gun body is to use metallic shaped charge holder as the pass-through conductor. This embodiment requires insulating the charge holder from the gun body. This insulation can be achieved using of one or more of: insulating end caps on the charge holder; insulating charge retainers on the apex end of the shaped charges; insulating caps on the open end of the shaped charges; an insulating sheath over the charge holder; an insulating tube in the annulus between the charge holder and the gun body; insulating coating on the charge tube; insulating coating on the inner surface of the gun body.

Another embodiment to enable electrical communication through a perforating gun without passing a wire though the gun body is to include a conductor integral with the detonating cord.

One embodiment to eliminate the need to make wire connections between perforating guns is to provide a receptacle or resilient connector that engages and maintains electrical contact as two perforating guns are threaded together.

One embodiment to house electrical and ballistic components in the perforating gun is to house the electrical and ballistic components in a cartridge inside the gun body. In a further embodiment, the cartridge fits inside an adapter inside the gun body so that a single cartridge diameter can be used in a variety of diameters of perforating gun bodies.

One example method of perforating a well includes the steps of: loading a first perforating gun with perforating charges and detonating cord; inserting a cartridge holding a detonator into the perforating gun; assembling the perforating gun in a tool string; conveying the tool string into the well; detonating the perforating charges. In a further example method of perforating a well the cartridge has at least one electrical contact proximate each end. In a further example method of perforating a well at least one of the electrical contacts of the cartridge is resiliently biased. In a further example method of perforating a well at least one of the electrical contacts of the cartridge is a compression spring. In a further example method of perforating a well at least one of the electrical contacts of the cartridge is a pin adapted to engage a socket. In a further example method of perforating a well the socket is resiliently biased toward the pin. In a further example method of perforating a well the cartridge also holds a switch electrically connected to the detonator. A further example method of perforating a well includes the step of conveying the first perforating gun to a well site after loading the first perforating gun with perforating charges and detonating cord. A further example method of perforating a well includes the step of conveying the first perforating gun to a well site after inserting the cartridge containing the detonator into the perforating gun. A further example method of perforating a well includes the step of connecting the first perforating gun to a second perforating gun by threading the body of the first perforating gun directly into the body of the second perforating gun.

One example method of manufacturing a perforating gun body includes the steps of receiving a metallic tube of substantially constant diameter from a first end to a second end; forming external threads in the first end; and forming internal threads in the second end; wherein the internal threads are adapted to engage the external threads. A further example method of manufacturing a perforating gun body includes the step of swaging down the diameter of the first end before forming the external threads. A further example method of manufacturing a perforating gun body includes the step of swaging up the diameter of the second end before forming the internal threads. In a further example method of manufacturing a perforating gun body the internal and external threads are self-sealing threads.

One example method of manufacturing a perforating gun body includes the steps of: receiving a metallic tube of substantially constant diameter from a first end to a second end; affixing a fitting to the first end; forming external threads in the fitting; and forming internal threads in the second end; where the internal threads are adapted to engage the external threads. In a further example method of manufacturing a perforating gun body the fitting is affixed to the first end by welding. In a further example method of manufacturing a perforating gun body the fitting is affixed to the first end by friction welding.

One example perforating gun system includes: a first gun body having external threads at a first end and internal threads at a second end; and a cartridge holding a detonator. A further example perforating gun system includes a switch electrically connected to the detonator. In a further example perforating gun system the cartridge holds the switch. In a further example perforating gun system the cartridge is adapted to be inserted and removed from the perforating gun as a unit. A further example perforating gun system includes a shaped charge loading tube having an upper end and a lower end; where the cartridge has an electrical contact proximate to the detonator and the lower end of the loading tube has an electrical contact adapted to contact the electrical contact proximate to the detonator. A further example perforating gun system includes at least one insulator between the shaped charge loading tube and the gun body. A further example perforating gun system includes an upper end fitting on the upper end of the shaped charge loading tube; and a lower end fitting on the lower end of the shaped charge loading tube. A further example perforating gun system includes an upper insulating cap on upper end fitting; a lower insulating cap on lower end fitting; and wherein the upper and lower end fittings are conductive. In a further example perforating gun system the at least one insulator comprises an insulating fitting on an apex end of a plurality of shaped charges. In a further example perforating gun system the at least one insulator comprises an insulating fitting on an open end of a plurality of shaped charges. In a further example perforating gun system the at least one insulator comprises an insulating sleeve over the shaped charge loading tube. In a further example perforating gun system the cartridge has at least one electrical contact at each end. In a further example perforating gun system at least one of the electrical contacts of the cartridge is resiliently biased. In a further example perforating gun system at least one of the electrical contacts of the cartridge is a compression spring. In a further example perforating gun system at least one of the electrical contacts of the cartridge is a pin adapted to engage a socket in the upper end fitting of the loading tube. In a further example perforating gun system the socket is resiliently biased toward the pin. In a further example perforating gun system the cartridge has at least one electrical contact at each end.

One example perforating gun system includes: a first metallic gun body; a first shaped charge loading tube; a first insulator between the gun body and the loading tube; and a cartridge holding a detonator and a switch; wherein the detonator is electrically connected to the switch. In a further example perforating gun system the cartridge is adapted to be inserted and removed from the perforating gun as a unit. A further example perforating gun system includes a shaped charge loading tube having an upper end and a lower end; wherein the cartridge has an electrical contact proximate to the detonator and the lower end of the loading tube has an electrical contact adapted to contact the electrical contact proximate to the detonator. A further example perforating gun system includes an upper end fitting on the upper end of the shaped charge loading tube; and a lower end fitting on the lower end of the shaped charge loading tube. A further example perforating gun system includes an upper insulating cap on upper end fitting; and a lower insulating cap on lower end fitting; wherein the upper and lower end fittings are conductive. In a further example perforating gun system the at least one insulator comprises an insulating fitting on an apex end of a plurality of shaped charges. In a further example perforating gun system the at least one insulator comprises an insulating fitting on an open end of a plurality of shaped charges. In a further example perforating gun system the at least one insulator comprises an insulating sleeve over the shaped charge loading tube. In a further example perforating gun system the cartridge has at least one electrical contact at each end. In a further example perforating gun system at least one of the electrical contacts of the cartridge is resiliently biased. In a further example perforating gun system at least one of the electrical contacts of the cartridge is a compression spring. In a further example perforating gun system at least one of the electrical contacts of the cartridge is a pin adapted to engage a socket in the upper end fitting of the loading tube. In a further example perforating gun system the socket is resiliently biased toward the pin.

One example perforating gun body includes: a substantially cylindrical tube; an upper end of the tube having internal threads; a lower end of the tube having external threads; wherein the lower end has a smaller diameter than the upper end. A further example perforating gun body includes internal threads in the lower end. A further example perforating gun body includes an alignment slot in an inner wall adapted to engage an alignment tab on a shaped charge loading tube. A further example perforating gun body includes an alignment slot in an inner wall adapted to engage an alignment tab on a shaped charge holder.

One example baffle for adapting a cartridge to a perforating gun includes a substantially cylindrical body, a cavity in the body adapted to receive a cartridge, internal threads in the cavity adapted to engage external threads on the cartridge, and external threads adapted to engage internal threads on a perforating gun body. A further example baffle for adapting a cartridge to a perforating gun includes tool flats adapted to allow a tool to rotate the baffle.

One example cartridge for use in a perforating gun includes: a cartridge body having an upper end and a lower end; a detonator proximate the upper end; a switch electrically connected to the detonator; a first electrical contact proximate the lower end; a first electrical contact proximate the upper end; where the first electrical contacts proximate the lower end and upper end are electrically connected to the switch. In a further example cartridge for use in a perforating gun the first electrical contact proximate the lower end is resiliently biased away from the upper end. In a further example cartridge for use in a perforating gun the first electrical contact proximate the upper end is resiliently biased away from the lower end. A further example cartridge for use in a perforating gun includes a second electrical contact proximate the lower end and electrically connected to the switch. In a further example cartridge for use in a perforating gun the second electrical contact proximate the lower end is resiliently biased away from the upper end. In a further example cartridge for use in a perforating gun the first electrical contact proximate the upper end comprises a conductive end cap. In a further example cartridge for use in a perforating gun the first electrical contact proximate the upper end further comprises a compression spring. In a further example cartridge for use in a perforating gun the first contact proximate the lower end comprises an insulated feed-through pin. A further example cartridge for use in a perforating gun includes external threads adapted to engage internal threads on a baffle. A further example cartridge for use in a perforating gun includes external threads adapted to engage internal threads on a perforating gun body.

One example shaped charge loading tube for use in a perforating gun includes: a conductive charge holder; an upper end fitting having a diameter larger than the diameter or width of the charge holder; a lower end fitting having a diameter larger than the diameter or width of the charge holder; wherein the upper end fitting and lower end fitting each comprise an insulating material about their outer circumference. In a further example shaped charge loading tube the upper and lower end fitting each further comprises a conductive puck that is electrically connected to the charge holder. In a further example shaped charge loading tube the upper end fitting further comprises an electrical contact that is electrically connected to the charge holder. In a further example shaped charge loading tube the upper end fitting further comprises an electrical contact that is electrically connected to the charge holder. In a further example shaped charge loading tube the upper end fitting further comprises an alignment tab adapted to engage an alignment slot on an interior wall of a perforating gun body. In a further example shaped charge loading tube the upper end fitting further comprises an insulating cap. In a further example shaped charge loading tube the upper end fitting further comprises conductive puck. In a further example shaped charge loading tube the conductive puck further comprises an alignment slot. In a further example shaped charge loading tube the upper insulating cap further comprises an external alignment tab adapted to engage an alignment slot in a perforating gun body and an internal alignment tab adapted to engage an alignment slot in the conductive puck. In a further example shaped charge loading tube the upper end fitting further comprises an alignment tab adapted to engage an alignment slot on an interior wall of a perforating gun body.

One example shaped charge loading tube end fitting includes: a body having a central axis; a detonator bore coaxial with the central axis adapted to accept a detonator; a detonating cord bore with an axis at an angle greater than zero from the central axis; wherein the detonating cord bore is adapted to accept detonating cord and intersects the detonator bore. In a further example shaped charge loading tube end fitting the axis of the detonating cord bore is offset from the central axis of the body by approximately 35 degrees.

DETAILED DESCRIPTION

Directional and orientation terms such as upper, lower, top, and bottom are used in this description for convenience and clarity in describing the features of components. However, those terms are not inherently associated with terrestrial concepts of up and down or top and bottom as the described components might be used in a well.

Figure 1:
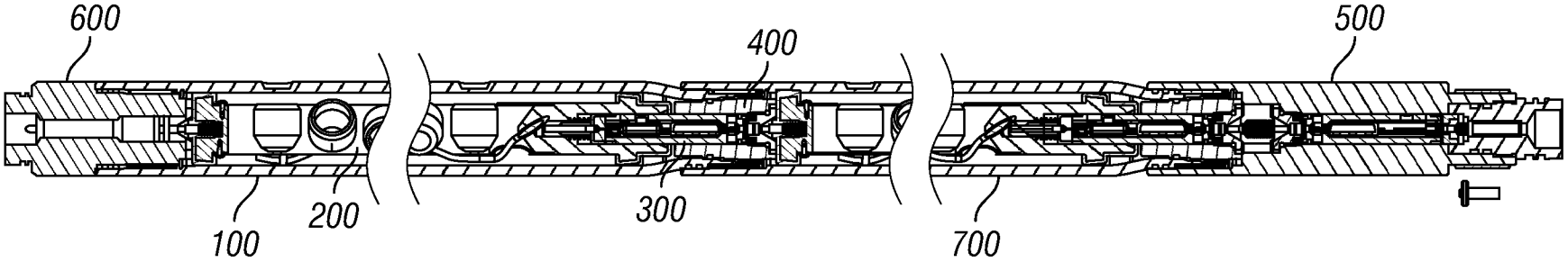
FIG. 1 is a cross-sectional view of an example embodiment of a perforating gun system.
Figure 4:
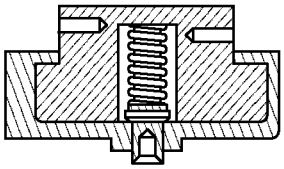
FIG. 4 is a cross-sectional view of the top end fitting assembly from the example embodiment of a perforating gun system in FIG. 1.
Figure 3:
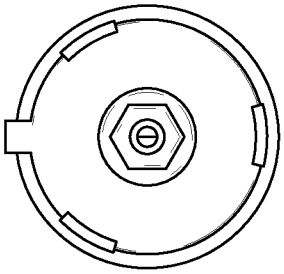
FIG. 3 is an end view of the top end fitting assembly from the example embodiment of a perforating gun system in FIG. 1.
Figure 2:
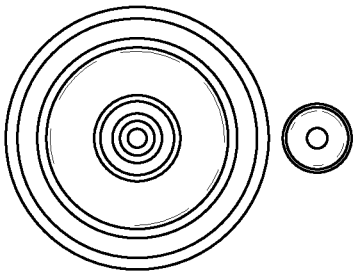
FIG. 2 is an end view of the example embodiment of a perforating gun system shown in FIG. 1.
Figure 5:
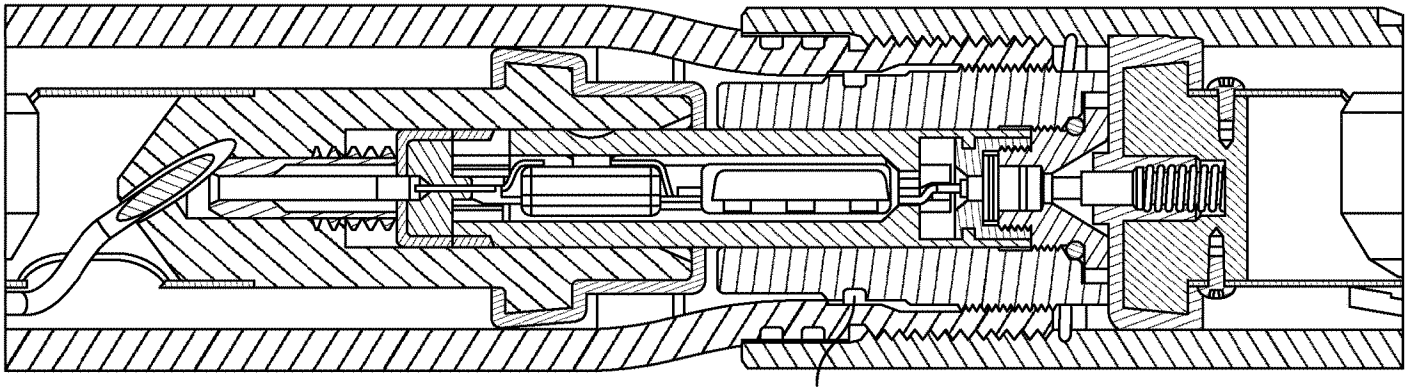
FIG. 5 is a cross-sectional view of the male end of one perforating gun mated to the female end of another perforating gun in the example embodiment of a perforating gun system shown in FIG. 1.
Figure 6:
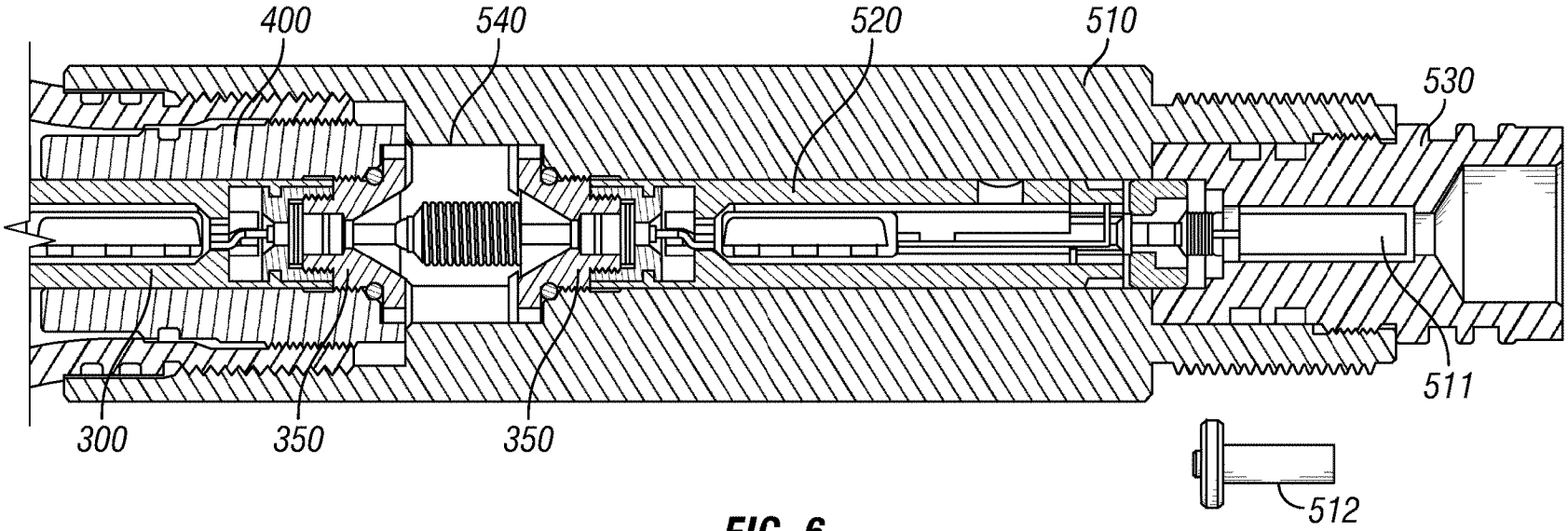
FIG. 6 is a cross sectional view of a plug-shoot adapter of the example embodiment of a perforating gun system shown in FIG. 1.

FIG. 1 illustrates one example embodiment of a perforating gun system. FIG. 1 shows a top gun adapter sub assembly 600, a first perforating gun 100, a second perforating gun 700, and a plug and shoot adapter 500.

Figure 7:
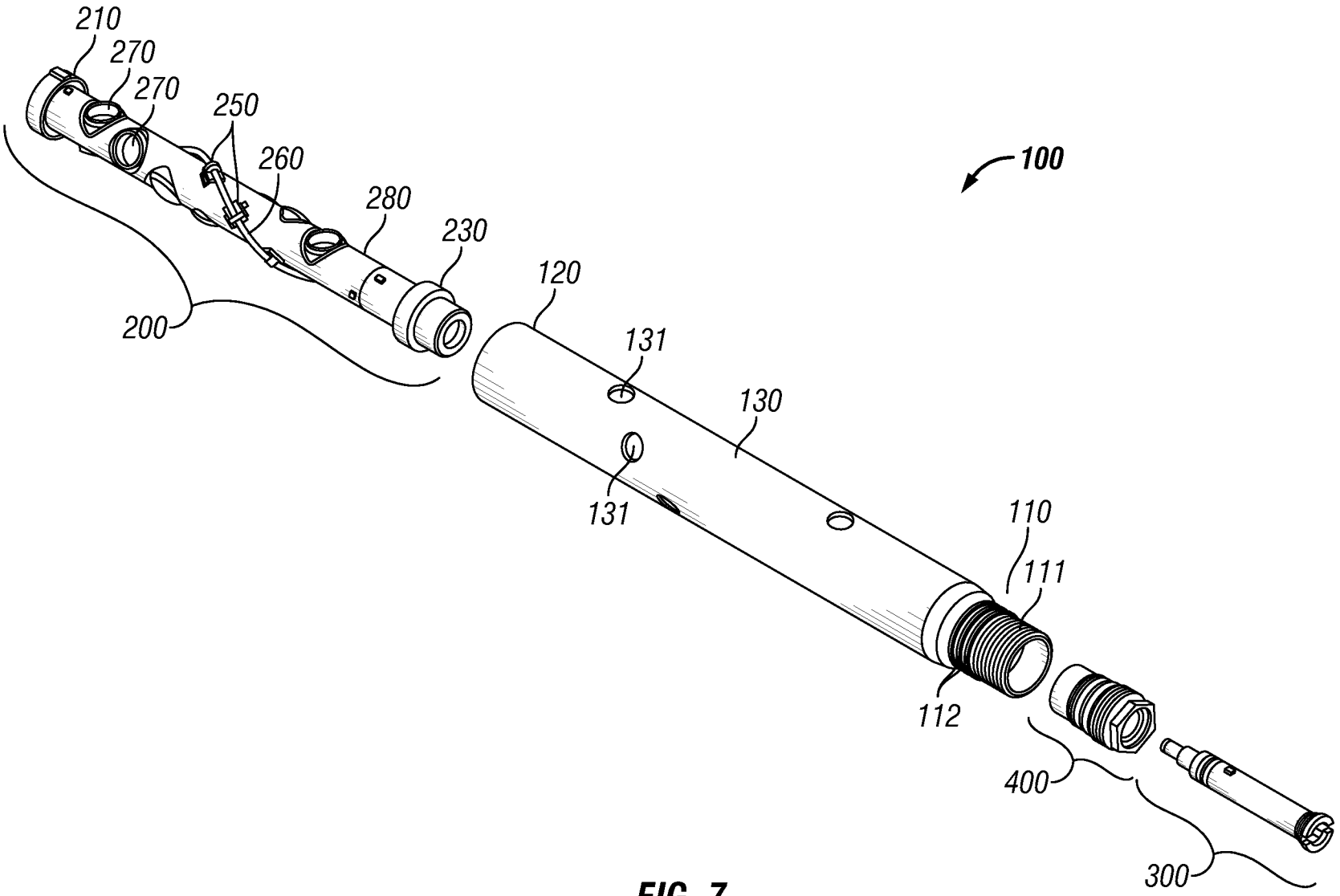
FIG. 7 is an exploded perspective view of an example embodiment a perforating gun assembly.
Figure 8A:
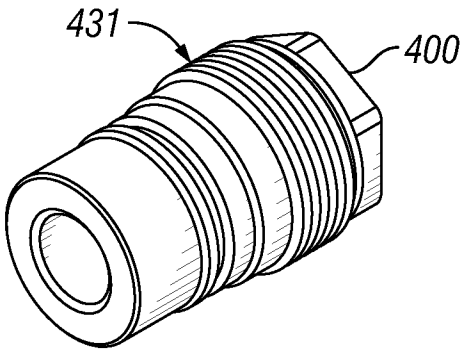
FIG. 8A is a perspective view of the baffle of the example embodiment of a perforating gun system shown in FIG. 1.
Figure 8B:
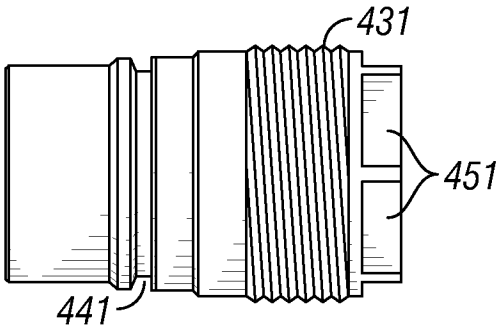
FIG. 8B is a side view of the baffle shown in FIG. 8A.
Figure 8C:
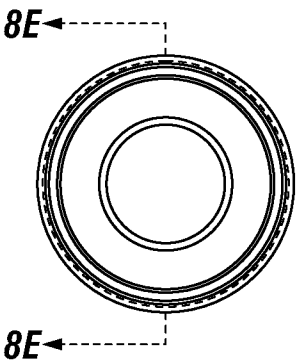
FIG. 8C is an end view of the baffle shown in FIG. 8A.
Figure 8D:
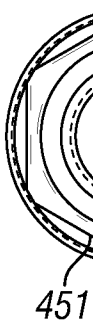
FIG. 8D is an end view of the baffle shown in FIG. 8A.
Figure 8E:
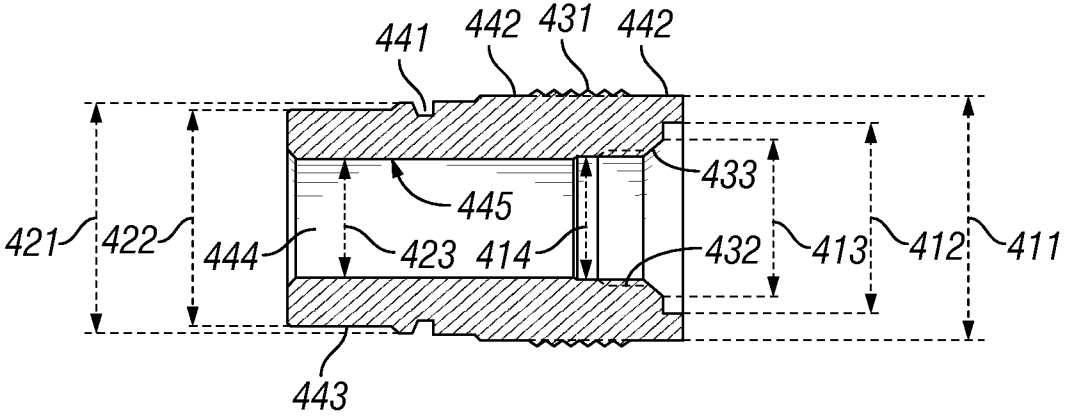
FIG. 8E is a cross-sectional view of the baffle shown in FIG. 8A.
Figure 9A:
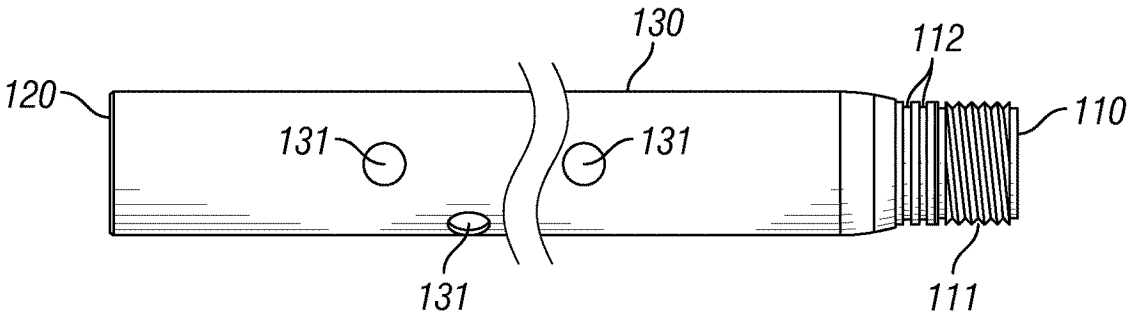
FIG. 9A is a side view of an example embodiment of a perforating gun body.
Figure 9C:
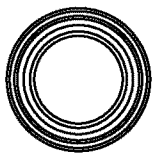
FIG. 9C is an end view of the example embodiment of a perforating gun body shown in FIG. 9A.
Figure 9B:
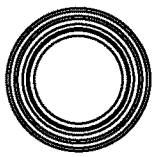
FIG. 9B is an end view of the example embodiment of a perforating gun body shown in FIG. 9A.
Figure 9D:
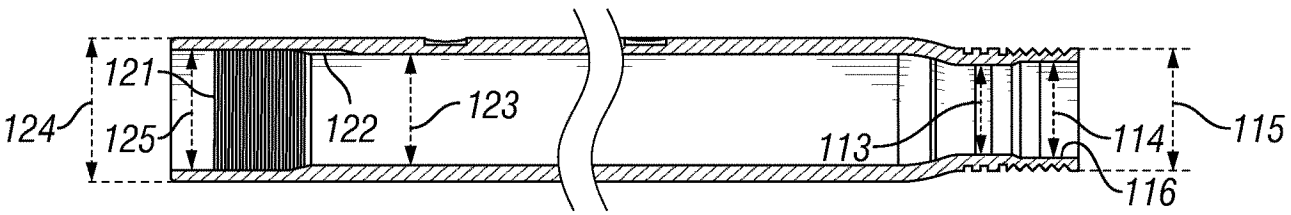
FIG. 9D is a cross-sectional view of the example embodiment of a perforating gun body shown in FIG. 9A.
Figure 43:
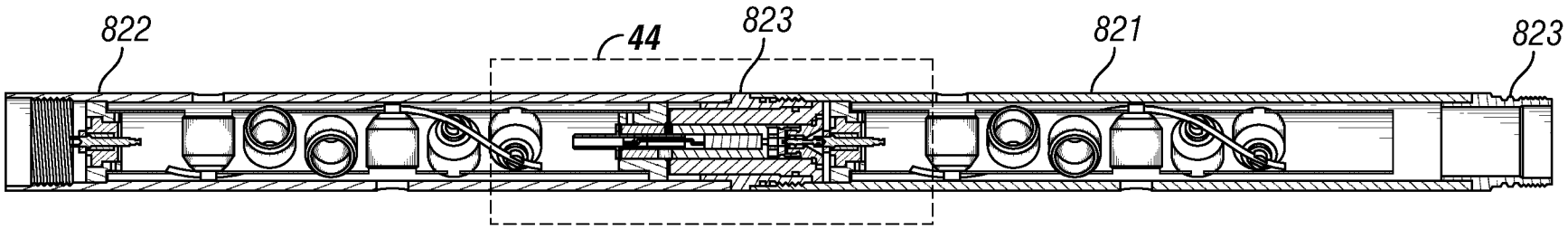
FIG. 43 is a cross-sectional view of an example embodiment of a perforating gun system.
Figure 44:
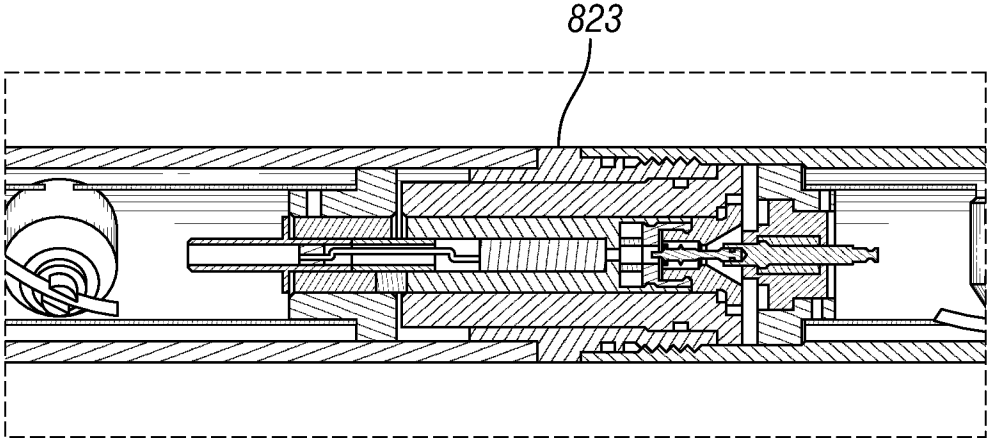
FIG. 44 is a cross-sectional view of the male end of one perforating gun mated to the female end of another perforating gun in the example embodiment of a perforating gun system shown in FIG. 43.

FIG. 7 shows an exploded view of example perforating gun 100. The perforating gun 100 includes a shaped charge loading tube assembly 200, a cartridge 300, and a baffle 400. Perforating gun 100 includes gun body 130. FIGS. 9, 9A, 9B, and 9C show an example embodiment of gun body 130. Gun body 130 includes a male end 110 and a female end 120. Male end 110 has an external diameter 115, a first internal diameter 113, and a second larger internal diameter 114. Female end 120 has an external diameter 124, a first internal diameter 123, and a second larger internal diameter 125. Male end 110 also has o-ring grooves 112. Male end 110 also includes internal threads 116 for engaging corresponding external threads 431 on baffle 400. Corresponding threads are understood to be designed and adapted to engage and affix to one another, for example, male and female threads of the same design would correspond to each other because they are adapted to engage and affix to one another. Corresponding threads may not always actually engage and affix to one another, for example, threads on opposite ends of a perforating gun may be adapted to engage each other, but in practice actually engage threads on other similar or matching perforating guns. Gun body 130 has o-ring grooves 112 housing o-rings to provide a fluid pressure seal between one gun body an another gun body or other tool string component. Gun body 130 can be formed from a standard thin-walled tubing material by swaging male end 110 down in diameter and then machining additional features, such as threaded sections 121, 111, and o-ring grooves 112. The swaging process allows the material of gun body 130 to maintain desired strength from thin-walled tubing when reducing the diameter to allow corresponding male threads 111 and female threads 121 on opposite ends of gun body 130. Alternatively, a fitting can be welded onto one end of a gun body to enable male threads 111, o-ring grooves 112, first internal diameter 113 and second internal diameter 114 to be formed in the fitting. Those features can be formed either before or after welding the fitting onto gun body 130. A welded fitting example is shown in FIGS. 43 and 44. Male end 110 has a smaller internal diameter 113 and external diameter 115 than internal; diameter 123 and external diameter 124 of female end 120. Gun body 130 has scallops 131 corresponding to the locations of shaped charges 270. Gun body 130 has an alignment slot 122 in its inner surface to engage alignment tab 211 top insulation cap 210 of loading tube assembly 200. Loading tube assembly 200 need not necessarily have a tubular shape.

Alternatively, gun body 130 may be formed with male threads and female threads on ends of substantially the same diameter. Certain threads designs may be able to maintain needed strength when cut into the inner and outer surfaces of standard thin-walled tubing. For example, the following premium threads may be used: Tenaris (all versions), CS Hydril, Full Hole (drill pipe), MT, AMT, AMMT, PAC, AMERICAN OPEN HOLE, various HUGHES thread configurations, BTS-8, BTS-6, BTS-4, ECHO-F4, ECHO-SS, BFJ, BNFJ, SBFJP, Drillco SSDS and other Drillco threads, THE NU THREADS, NU 8RD, NU 10RD, SEAL-LOCK, and WEDGE-LOCK. Alternatively, gun body 130 could be formed by swaging up one end to accommodate female threads corresponding to made threads on the original diameter end.

The following thread types can eb used for various aspects of the disclosed perforating gun systems and components: TPI, GO Acme, SIE, Acme Thread, Stub Acme Thread, Molded Thread, Formed Thread, Premium Thread, Flush Joint Thread, Semi-Flush joint Thread, API Thread, EUE/Round Thread, Tapered Thread, V-thread, J-Latch, Breech Lock, Tenaris (all versions), CS Hydril, Full Hole (drill pipe), MT, AMT, AMMT, PAC, AMERICAN OPEN HOLE, various HUGHES thread configurations, BTS-8, BTS-6, BTS-4, ECHO-F4, ECHO-SS, BFJ, BNFJ, SBFJP, Drillco SSDS and other Drillco threads, THE NU THREADS, NU 8RD, NU 10RD, SEAL-LOCK, and WEDGE-LOCK.

Additionally, double or triple lead versions of the above threads bay also be used for faster make-up.

FIGS. 8A, 8B, 8C, 8D and 8E provide various views of an example embodiment of a baffle 400. Baffle 400 acts as an adapter and seal between cartridge 300 and gun body 130. Baffle has a first external surface 443 proximate its upper end and a second external surface 442 proximate its lower end. Baffle 400 has a first external diameter 411, a second external diameter 421, and a third external diameter 422. Baffle 400 has a bore 44F30E4 with a first internal surface 414. Bore 444 has a first internal diameter 412, a second internal diameter 413, a third internal diameter 414, and a fourth internal diameter 423. Baffle 400 has external threads 431 adapted to engage external threads 116 on gun body 130. O-ring groove 441 is adapted to hold an o-ring 461 for sealing against the inside of gun body 130. Baffle 400 includes internal threads 432 to engage first threaded portion 355 on bulkhead retainer 350. Baffle 400 includes a chamfer 433 in the internal bore 444 proximate the second end to aid assembly of cartridge 300 and baffle 400. Baffle 400 includes wrench flats 451 to aid in threading and unthreading baffle 400 to and from gun body 130 and bulkhead retainer 350. Baffle 400 can be constructed with a variety of external sizes to fit within a variety of diameters of perforating guns with a standard internal bore to accept standard size cartridges. Alternatively, baffle 400 may be made without threads and with push-in retainer features instead. Alternatively, baffle 400 may be eliminated and cartridge 300 sized to fit each perforating gun. In a further alternative, each perforating gun body may be made with a cavity sized to fit a common cartridge.

Figure 10:
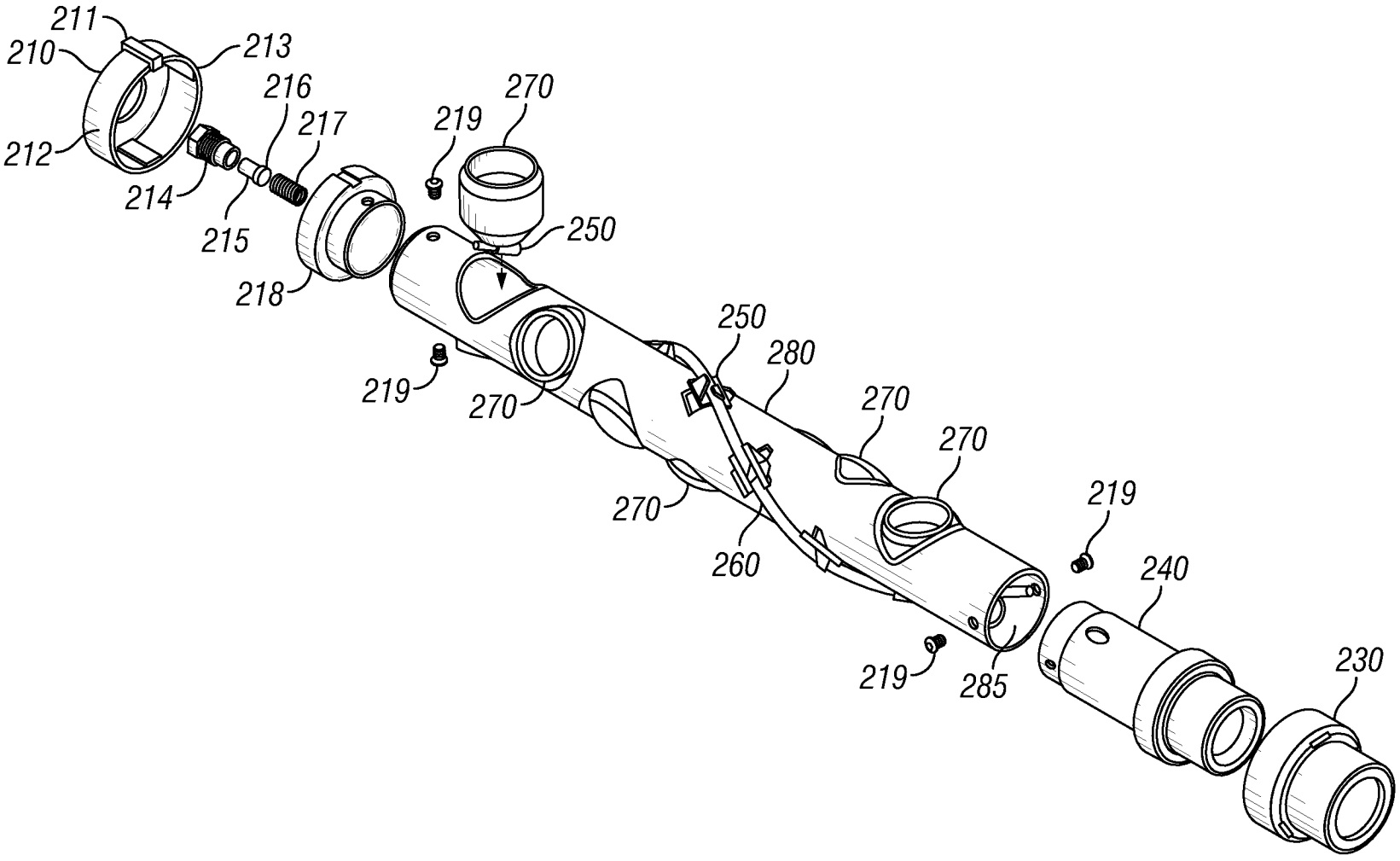
FIG. 10 is an exploded perspective view of an example embodiment of a shaped charge loading tube assembly.

FIG. 10 provides an exploded perspective view of an example embodiment of a loaded shaped charge loading tube assembly 200. Loaded shaped charge loading tube assembly 200 includes a charge tube 280, a top insulation cap 210, a bottom insulation cap 230, a number of shaped charges 270 with charge retainers 250, and detonating cord 260. Shaped charge 270 is a typical shaped explosive perforating charge including a case, a liner, and explosive material. Alignment tab 211 on top insulation cap 210 engages with alignment slot 122 in gun body 130.

Figure 11A:
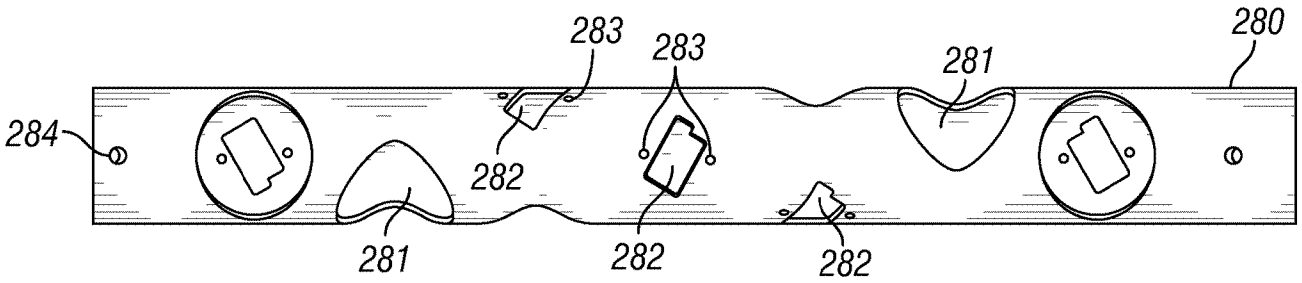
FIG. 11A is a side view of the example embodiment of a charge tube component shown in FIG. 10.
Figure 11B:
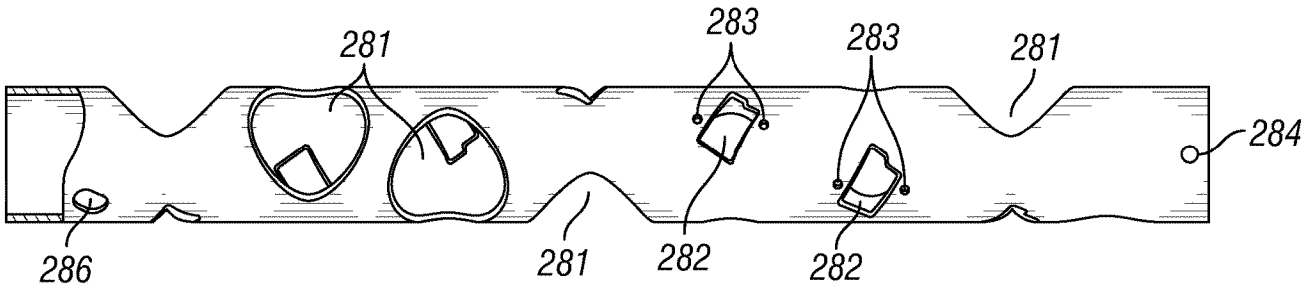
FIG. 11B is a side view of the example embodiment of a charge tube component shown in FIG. 10.
Figure 11C:
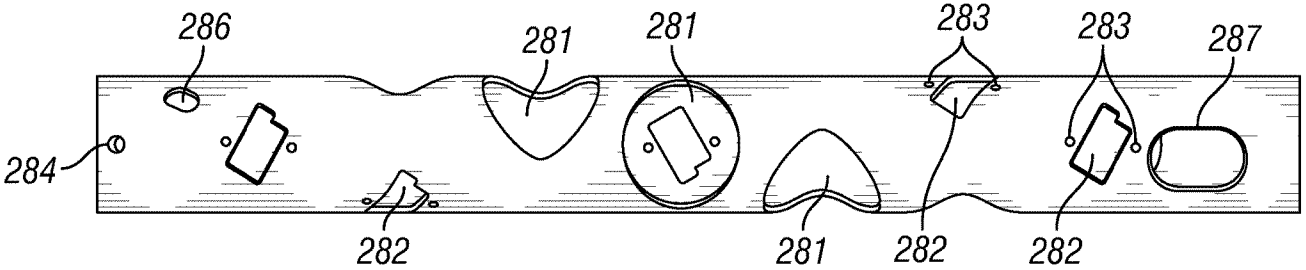
FIG. 11C is a side view of the example embodiment of a charge tube component shown in FIG. 10.
Figure 12C:
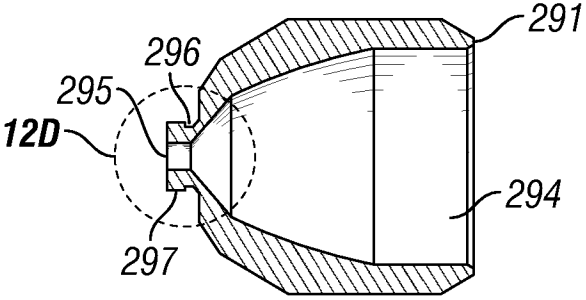
FIG. 12C is a cross-sectional view of an example embodiment of a shaped charge case.
Figure 12B:
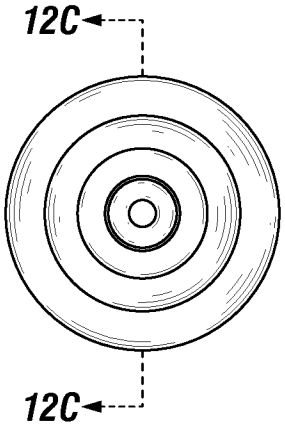
FIG. 12B is a view of the apex end of an example embodiment of a shaped charge case.
Figure 12A:
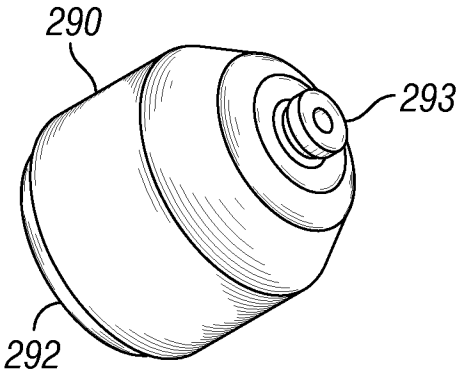
FIG. 12A is a perspective view of the apex end of an example embodiment of a shaped charge case.

FIGS. 11A, 11B, and 11C show various views of an example embodiment of a charge tube 280. Charge tube 280 has a number of charge holes 281, retainer holes 282, lock detents 283, and mounting screw holes 284. Charge tube 280 also has detonating cord hole 286 to allow detonating cord to pass from the exterior to the interior of the charge tube. Charge tube 280 has a large detonating cord hole 287 to allow detonating cord to pass from the exterior to the interior of the charge tube and provide sufficient access to insert detonating cord 260 into deto transfer puck 240. Retainer holes 282 are formed in a keyed rectangular shape corresponding to the shape of the retainers 250 to allow them pass through in one angular orientation. Charge holes 281 are formed in a substantially circular shape to accommodate shaped charges 270. Lock detents 283 can be formed as dimples, holes, or raised bumps in the outer surface of charge tube 280. Mounting screw holes 284, allow button screws 219 to secure charge tube 280 to feed through puck 218 and deto transfer puck 240. Alternatively, a charge holder could be constructed of non-tubular material, such as a strip or chain of material. Such alternative charge holder embodiments could be insulated using similar means to those described for the charge tube embodiment.

FIGS. 12A, 12B, 12C, and 12D show various views of an example embodiment of a charge case 290 component of shaped charge 270. Charge case 290 has an open end 292, an apex end 293, an internal cavity 294, and a primer channel 295. Open end 292 has a rim portion 291. The features of apex end 293 allow retainer 250 to attach to charge case 290. Apex end 293 has a protruding rim 297 and a detent 296. Protruding rim 297 has a chamfer 299 to aid retainer 250 in snapping over protruding rim. Alternatively apex end 293 could have an internal rim and detent or threads to affix retainer 250 to charge case 290.

Figure 13A:
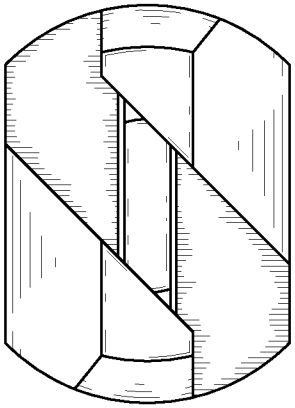
FIG. 13A is a top view of an example embodiment of a shaped charge retainer.
Figure 12D:
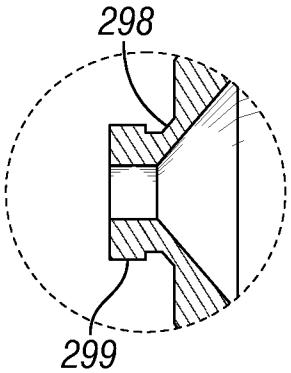
FIG. 12D is a cross-sectional view of the apex end of an example embodiment of a shaped charge case.
Figure 13B:
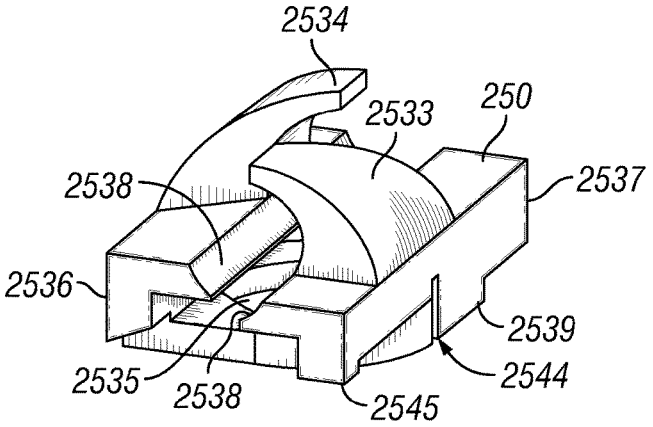
FIG. 13B is a perspective view of an example embodiment of a shaped charge retainer.
Figure 13D:
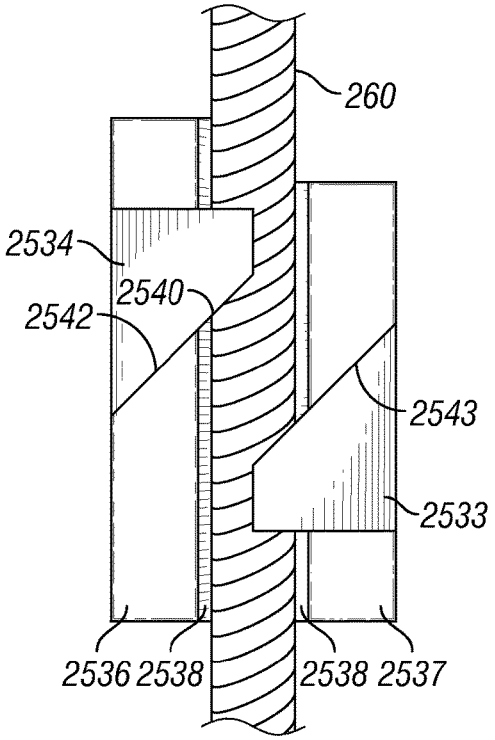
FIG. 13D is a top view of an example embodiment of a shaped charge retainer.
Figure 13C:
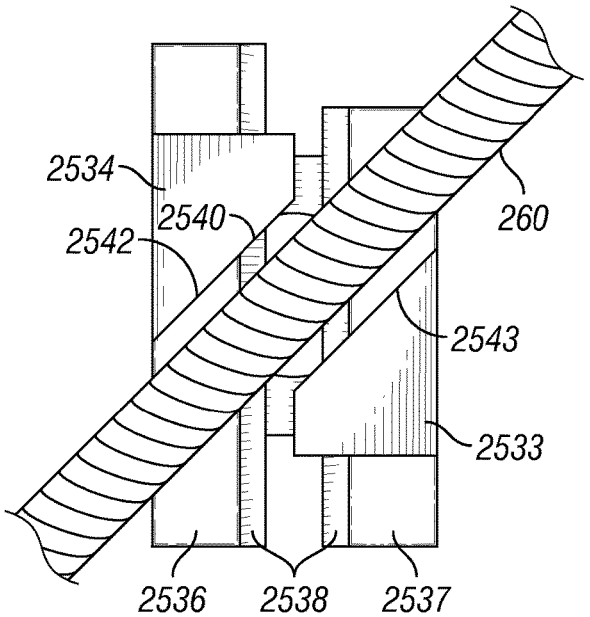
FIG. 13C is a top view of an example embodiment of a shaped charge retainer.
Figure 13E:
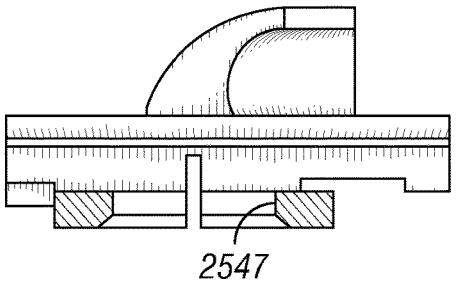
FIG. 13E is a side view of an example embodiment of a shaped charge retainer.
Figure 13F:
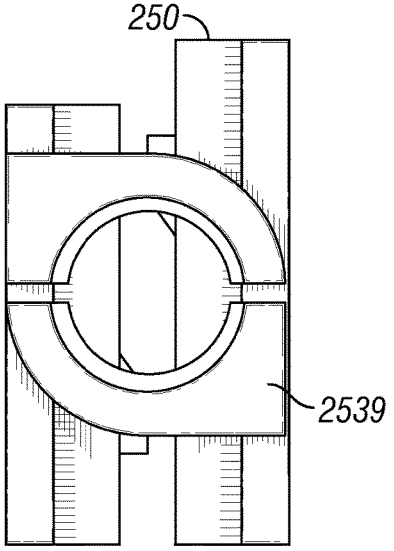
FIG. 13F is a bottom view of an example embodiment of a shaped charge retainer.

FIGS. 13A, 13B, 13C, 13D, and 13E show various views of an example embodiment of retainer 250. FIG. 13A is a perspective view of retainer 250. The retainer has a first detonation cord clamp 2533 and a second detonation cord clamp 2534. The retainer 250 has a circular opening 2535. The retainer 250 has two rectangular base portions 2536 and 2537. Base portion 2536 is longer than base portion 2537. Base portion 2536 is parallel to base portion 2537. Each of the rectangular base portions 2536 and 2537 contain fillets 2538 that are adapted to accommodate the radius of a detonating cord 260. As seen in FIG. 13C, the retainer 250 has an adaptor 2539 which allows for the retainer 250 to lock into place on the apex end 293 of the shaped charge case 290 upon installation. The retainer 250 has a lock block 2545 that is adapted to fit into the retainer hole 282 on the charge tube 280 as shown in FIG. 11A. The lock block 2545 is engaged by twisting the retainer until it reaches the desired orientation whereby the lock detent 283 and lock block 2545 are aligned. The adaptor 2539 has a base slot 2544, in this example it is located perpendicular to the rectangular base portions 2536 and 2537. The base slot 2544 allows some flexibility in the adaptor 2539. In this example the adaptor 2539 is composed of a plastic material that may deform without yielding. The base slot 2544 aids in helping the adaptor 2539 yield. This added flexibility allows the adaptor 2539 to snap over the end fitting 2546 of a shaped charge case 270. The adaptor 2539 has an internal flange 2547 designed to assist in attaching the retainer 30 to the shaped charge case 290 apex end 293. In FIG. 13B the retainer 250 has detonation cord clamps 2533 and 2534. Clamp 2534 has an edge 2542 that is angled 45 degrees with respect to the parallel axis of rectangular base portions 2536 and 2537. Clamp 2533 has an edge 2543 that is also angled 45 degrees with respect to the parallel axis of rectangular base portions 2536 and 2537. Edge 2542 and edge 2543 are parallel to each other, forming slot 2540. Slot 2540 is wide enough to fit detonation cord 260 as depicted in FIG. 13B.

In at least one example, detonation cord clamps 2533 and 2534 are shaped as arches as viewed from the side in FIG. 13D. The procedure for securing the detonation cord 2532 is to first place it into slot 2540 as shown in FIG. 13B. Then, rotating the retainer 250 45 degrees forces the detonation cord 2532 against the fillets 2538 as shown in FIG. 13C. FIG. 13B shows the detonation cord 2532 as it is initially placed in the retainer 250. FIG. 13C depicts the detonating cord 260 as it sits in the retainer 250 after the retainer 250 has been rotated and locked into place on the charge tube 280. In other examples, lock block 2545 could be replaced by another locking feature such as a hole or detent designed to engage a corresponding locking feature on charge tube 280.

Figure 14B:
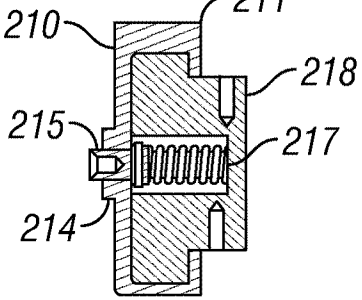
FIG. 14B is a cross-sectional view of an example embodiment of a top end fitting assembly of a perforating gun system.
Figure 14A:
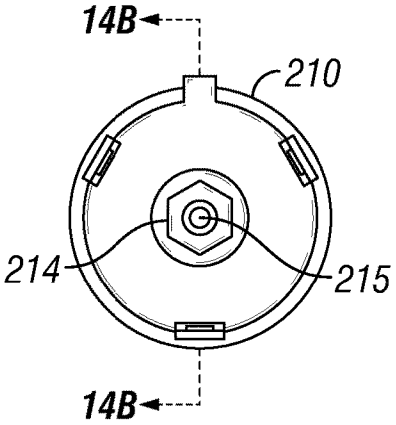
FIG. 14A is an end view of an example embodiment of a top end fitting assembly of a perforating gun system.

FIGS. 14A and 14B show an example embodiment of a top end fitting assembly for the shaped charge loading tube assembly 200. This top end fitting assembly includes a metallic feed through puck 218, a top insulation cap 210, a compression spring 217, a feed through contact pin 215, and a contact retainer 214. Top insulation cap 210 snaps over feed through puck 218. Feed through contact pin 215 is located in bore 2181 in feed through puck 218. Contact retainer 214 is threaded into feed through puck 218, capturing compression spring 217 and feed through contact pin 215 in bore 2181. Contact retainer 214 includes wrench flats to assist in attaching and detaching contact retainer 214 to feed through puck 218. Compression spring 217 biases feed through contact pin 215 away from feed through puck 218 to maintain electrical contact despite variations in manufacturing and assembly tolerances. Feed through pin 215 acts as a socket to receive bulkhead feed-through 340, which is an insulated pin.

FIGS. 18A, 18B, 18C, 18D, and 18E provide various views of feed through puck 218. Feed through puck 218 is made of a conductive material to allow feed through puck 218 to function as a conductor in the communications circuit, conducting signals from feed through contact pin 215 and compression spring 217 to charge tube 280. Feed through puck 218 has a partial bore 2181 sized to accept compression spring 217 and feed through contact pin 215. Bore 2181 has internal threads 2184 adapted to engage corresponding external threads on contact retainer 214. Feed through puck 218 also has an alignment slot 2182 to engage internal alignment tab 2106 on top insulation cap 210 to prevent relative rotation of the feed through puck 218 and top insulation cap 210. Feed through puck 218 has a larger diameter portion 2185 and a smaller diameter portion 2186 sized to fit inside top end of charge tube 280. Mounting holes 2183 in feed through puck 218 are threaded to accept button screws 219 to affix feed through puck 218 to charge tube 280.

FIGS. 19A, 19B, 19C, 19D, and 19E provide various views of top insulation cap 210. Top insulation cap 210 includes top portion 2104, side wall 2101, internal alignment tab 2106, and external alignment tab 2105. Top portion 2104 has an aperture 2103 to expose feed through contact pin 215. Side wall 2101 has an inner surface 2108 that is angled relative to the central axis of top insulating cap 210 and a retention protrusion 2107 adapted to snap over feed through puck 218. Side wall 2101 is interrupted by slots 2102 to enable side wall 2101 to flex and snap on feed through puck 218.

Figure 16B:
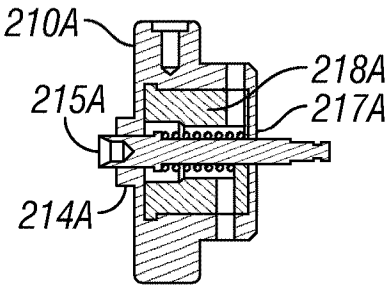
FIG. 16B is a cross-sectional view of an example embodiment of a top end fitting assembly of a perforating gun system.
Figure 16A:
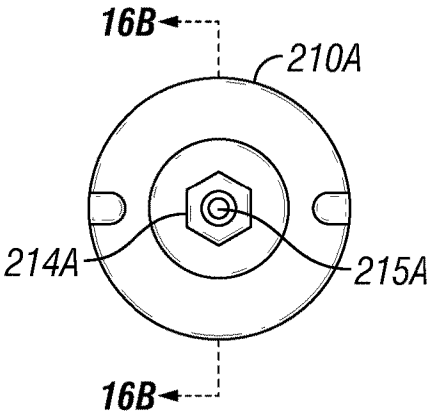
FIG. 16A is an end view of an example embodiment of a top end fitting assembly of a perforating gun system.
Figure 18C:
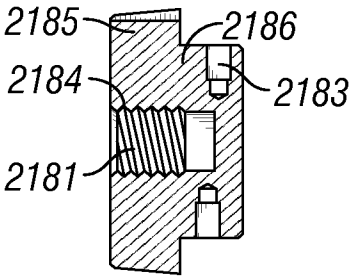
FIG. 18C is a cross-sectional view of an example embodiment of a feed thru puck of the perforating gun system shown in FIG. 1.
Figure 18B:
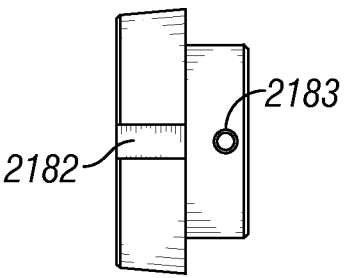
FIG. 18B is a side view of an example embodiment of a feed thru puck of the perforating gun system shown in FIG. 1.
Figure 18A:
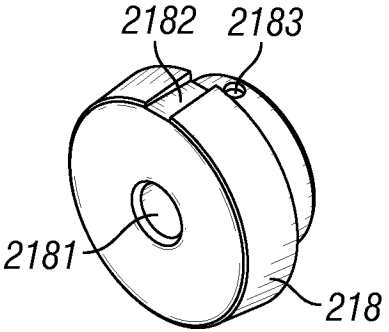
FIG. 18A is a perspective view of an example embodiment of a feed thru puck of the perforating gun system shown in FIG. 1.
Figure 18E:
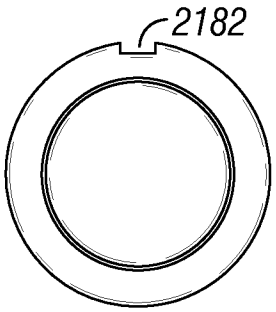
FIG. 18E is an end view of an example embodiment of a feed thru puck of the perforating gun system shown in FIG. 1.
Figure 18D:
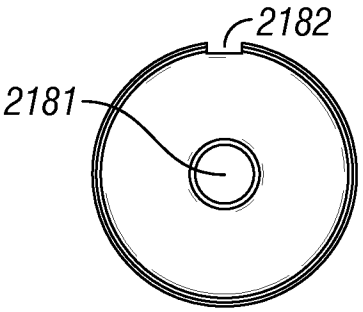
FIG. 18D is an end view of an example embodiment of a feed thru puck of the perforating gun system shown in FIG. 1.
Figure 19A:
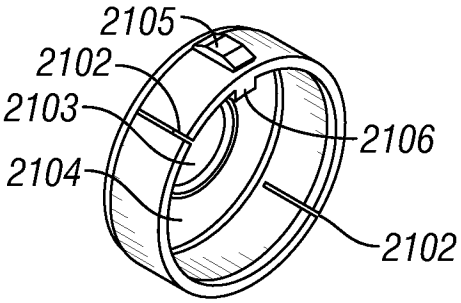
FIG. 19A is a perspective view of an example embodiment of a top insulation cap of the perforating gun system shown in FIG. 1.
Figure 19B:
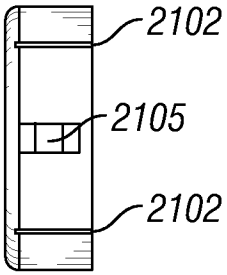
FIG. 19B is a side view of an example embodiment of a top insulation cap of the perforating gun system shown in FIG. 1.
Figure 19C:
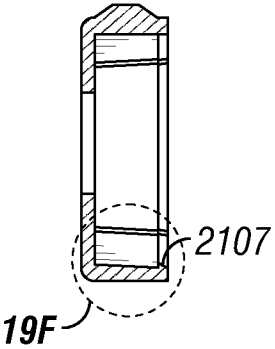
FIG. 19C is a cross-sectional view of an example embodiment of a top insulation cap of the perforating gun system shown in FIG. 1.
Figure 19D:
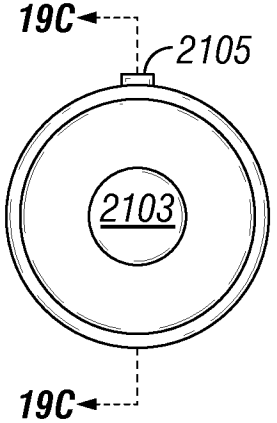
FIG. 19D is an end view of an example embodiment of a top insulation cap of the perforating gun system shown in FIG. 1.
Figure 19E:
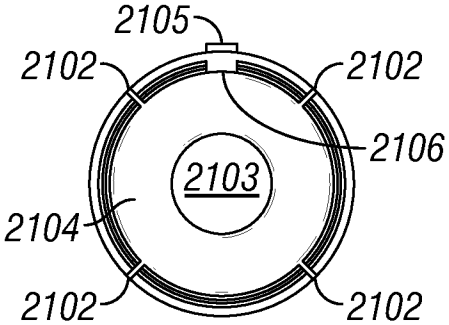
FIG. 19E is an end view of an example embodiment of a top insulation cap of the perforating gun system shown in FIG. 1.
Figure 19F:
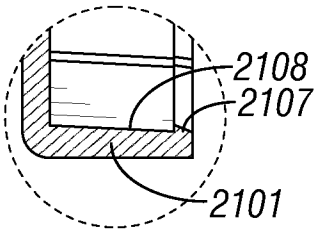
FIG. 19F is a detail view of FIG. 19C.
Figure 20A:
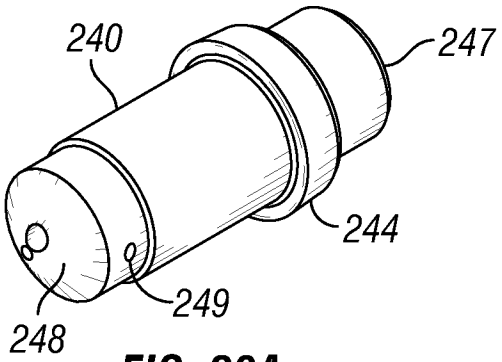
FIG. 20A is a perspective view of an example embodiment of a deto transfer puck of a perforating gun system.
Figure 20B:
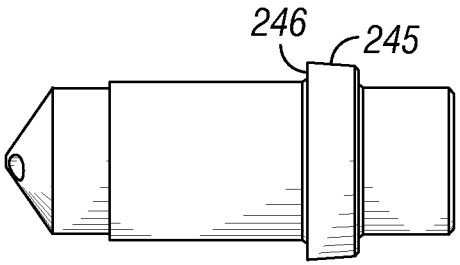
FIG. 20B is a side view of an example embodiment of a deto transfer puck of a perforating gun system.
Figure 20C:
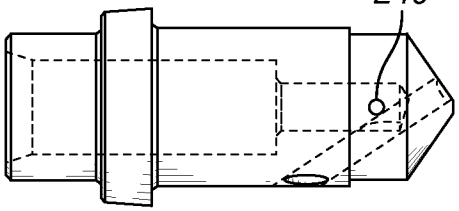
FIG. 20C is a side view of an example embodiment of a deto transfer puck of a perforating gun system.
Figure 20D:
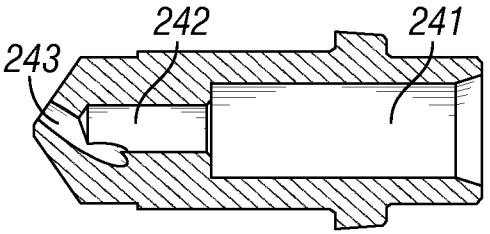
FIG. 20D is a cross-sectional view of an example embodiment of a deto transfer puck of the perforating gun system of FIG. 1.
Figure 20E:
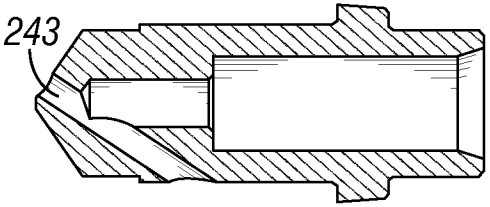
FIG. 20E is a cross-sectional view of an example embodiment of a deto transfer puck of a perforating gun system.
Figure 20F:
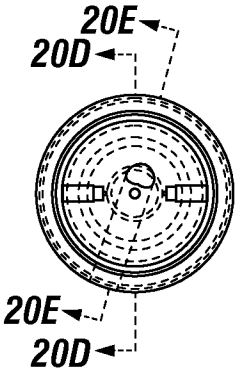
FIG. 20F is an end view of an example embodiment of a deto transfer puck of a perforating gun system.
Figure 21A:
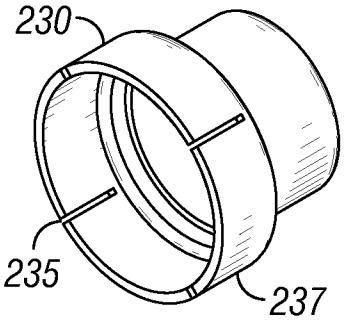
FIG. 21A is a perspective view of an example embodiment of a bottom insulation cap of the perforating gun system shown in FIG. 1.
Figure 21B:
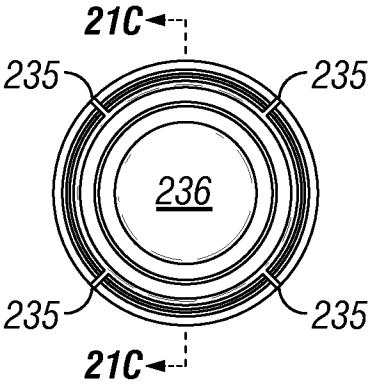
FIG. 21B is a side view of an example embodiment of a bottom insulation cap of the perforating gun system shown in FIG. 1.
Figure 21C:
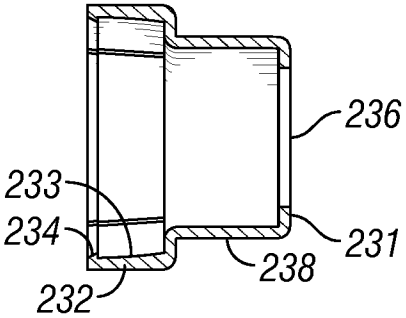
FIG. 21C is a cross-sectional view of an example embodiment of a bottom insulation cap of the perforating gun system shown in FIG. 1.
Figure 21D:
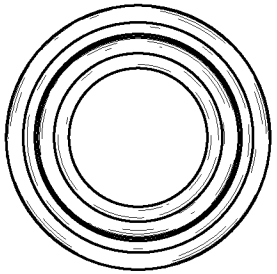
FIG. 21D is an end view of an example embodiment of a bottom insulation cap of the perforating gun system shown in FIG. 1.

FIGS. 16A and 16B show another example embodiment of a top end fitting assembly for the shaped charge loading tube assembly 200. This top end fitting assembly includes a metallic feed through puck 218A, a top insulation cap 210A, a compression spring 217A, a feed through contact pin 215A, and a contact retainer 214A. These components function and assemble similarly to those shown in FIGS. 14A and 14B. However, in this example embodiment, feed through contact pin 215A extends through feed through puck 218A, negating the need for feed through puck 218A to act as a conductor of electrical signals.

In alternative embodiments, side wall 2101 could be made of a plurality of fingers adapted to clip onto feed through puck 218 and prevent feed through puck 218 and charge tube 280 from coming into electrical contact with gun body 130 once the perforating gun system is assembled.

Figure 15:
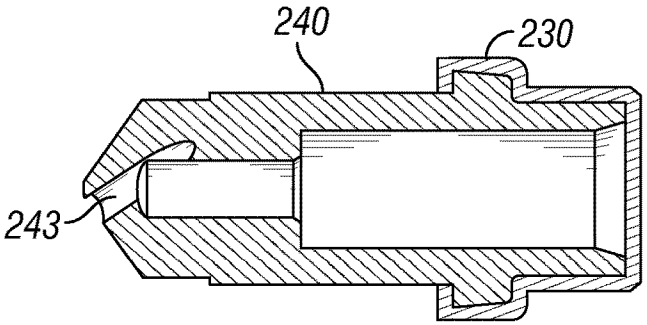
FIG. 15 is a cross-sectional view of an example embodiment of a bottom end fitting assembly of a perforating gun system.

FIG. 15 shows an example embodiment of a top end fitting assembly for the shaped charge loading tube assembly 200. The top end fitting assembly includes a deto transfer puck 240 and a bottom insulation cap 230.

FIGS. 20A, 20B, 20C, 20D, 20E, and 20F show an example embodiment of a deto transfer puck 240. Deto transfer puck 240 has an upper end 248 and a lower end 247. Deto transfer puck 240 has a first bore 241, a second bore 242, and a detonating cord bore 243. First bore 241 is sized to accommodate cartridge 300. Second bore 242 is sized to accommodate the cartridge end cap 370 of cartridge 300. Detonating cord bore is sized to accommodate detonating cord. First bore 241 and second bore 242 are coaxial with each other and the body of transfer puck 240. Second bore 242 and detonating cord bore 243 intersect each other to allow detonation energy from a detonator in second bore 242 to detonate detonating cord in bore 243. Second bore 242 is smaller in diameter than first bore 241. Deto transfer puck 240 also has a ring portion 244 with an angled outer surface 245 and a shoulder 246 to allow bottom insulation cap 230 to snap onto deto transfer puck 240. Ring portion 244 also provides an offset from the inner wall of gun body 130 to center charge tube 280 in gun body 130. Alternatively, bottom insulating cap could screw or both onto deto transfer puck 240. Deto transfer puck upper end 248 is sized to fit in the end of charge tube 280. Mounting holes 249 in deto transfer puck 240 are threaded to accept button screws 219 to affix deto transfer puck 240 to charge tube 280. The axis of detonating cord bore 243 is angled relative to the axis of second bore 242. Detonating cord bore 243 extends past the centerline of second bore 242. This arrangement of detonating cord bore 243 and second bore 242 allows a detonator in second bore 242 to detonate detonating cord in bore 243 despite variations in the length of that detonating cord. The axis of detonating cord bore 243 is optimally offset form that of second bore 242 by approximately 35 degrees. This eliminates a potential area for failure in traditional perforating gun designs where the detonator and detonating cord are arranged on a common axis, which requires that the detonating cord length be relatively tightly controlled to ensure detonation of the detonating cord. In this embodiment, deto transfer puck 240 is formed of a conductive material so that it can conduct communications signals from the charge tube 280.

FIGS. 21A, 21B, 21C, and 21D provide various views of an example embodiment of a bottom insulating cap 230. Bottom insulating cap 230 has a bottom portion 231, a first side wall 238, a second side wall 232, and an internal cavity 237. Bottom portion 231 has an aperture 236 sized so that bottom portion 231 does not obstruct access to first bore 241 in deto transfer puck 240. Second sidewall 232 has a larger average internal diameter than first sidewall 238. Second sidewall 232 has an inner surface that is angled relative to the central axis of bottom insulating cap 230 and a retention protrusion 234 adapted to snap over ring portion 244 of deto transfer puck 240. Second sidewall 232 is interrupted by slots 235 to enable second side wall 232 to flex and snap on deto transfer puck 240. Bottom insulating can insulates deto transfer puck, and by association charge tube 280 from gun body 130.

In alternative embodiments, second side wall 232 could be made of a plurality of fingers adapted to clip onto deto transfer puck 240 and prevent deto transfer puck 240 and charge tube 280 from coming into electrical contact with gun body 130 once the perforating gun system is assembled. Alternatively, charge holder 280 could be used as a feed-through communications conductor by insulating it from gun body 130 using any means. This insulation can be achieved using of one or more of: insulating end caps on the charge holder; insulating charge retainers on the apex end of the shaped charges; insulating caps on the open end of the shaped charges; an insulating sheath over the charge loading tube assembly; an insulating tube in the annulus between the charge holder and the gun body; insulating coating on the charge tube; insulating coating on the inner surface of the gun body.

Figure 17:
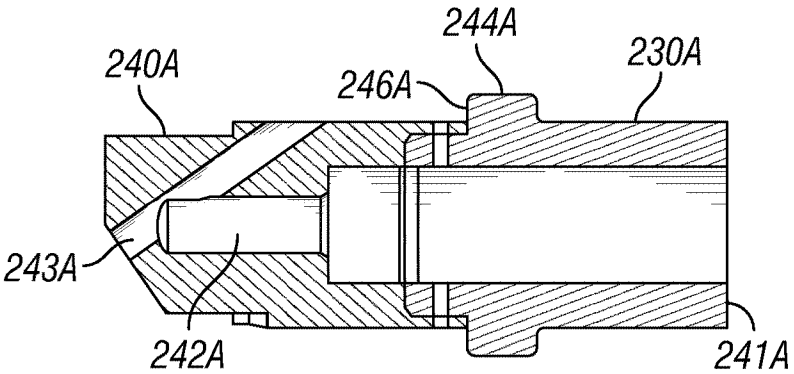
FIG. 17 is a cross-sectional view of an example embodiment of a bottom end fitting assembly of a perforating gun system.

FIG. 17 shows another example embodiment of a top end fitting assembly for the shaped charge loading tube assembly 200. In this embodiment, bottom insulating cap 230A does not snap onto deto transfer puck 240A, but is instead affixed to the deto transfer puck by button screws 219 passing through charge tube 280, deto transfer puck 240A and into threaded holes in bottom insulating cap 230A. First bore 241A extends through the bottom insulating cap 230A and into deto transfer puck 240A. Additionally, detonating cord bore 243A passes completely through deto transfer puck 243A. Other than these distinctions, the components in this embodiment are configured and operate similarly to those shown in FIG. 15.

In alternative embodiments, button screws 219 and associated features could be replaced by threads, welded connections, snap fit parts, or other well-known means to attach the shaped charge loading tube end fittings to the charge tube 280. In further alternative embodiments, top insulating cap 210A and 218A could be made together of an insulating material.

The shaped charges 270 are aligned with scallops 131 by aligning a charge hole 281 with alignment slot 2182 and aligning alignment slot 122 with a corresponding scallop 131 because alignment slot 2182 engages alignment tab 2106, which is aligned with alignment tab 211 which engages alignment slot 122.

Figure 39:
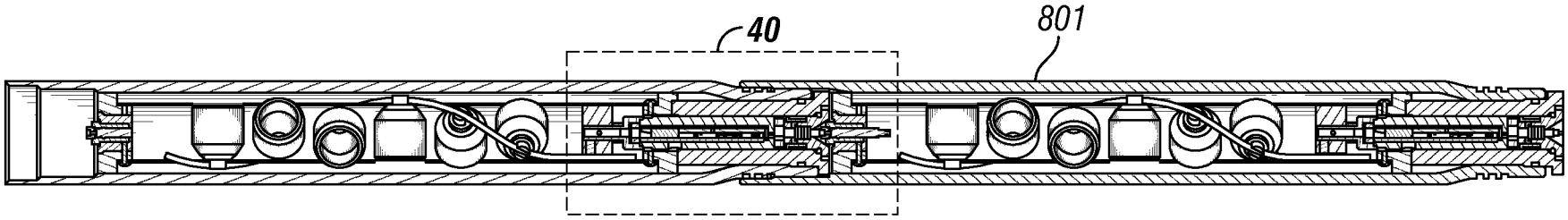
FIG. 39 is a cross-sectional view of an example embodiment of a perforating gun system.
Figure 40:
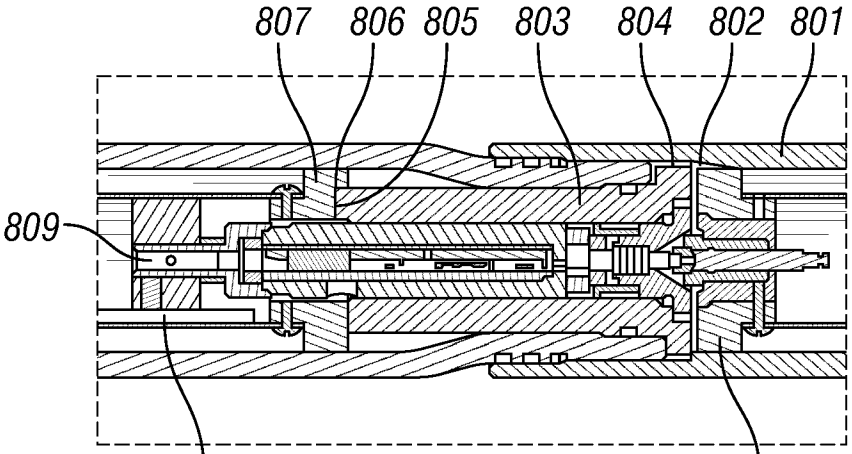
FIG. 40 is a cross-sectional view of the male end of one perforating gun mated to the female end of another perforating gun in the example embodiment of a perforating gun system shown in FIG. 39.

FIGS. 39 and 40 provide cross-sectional views of another example embodiment of a perforating gun system. In this example, alignment tab 804 on bottom end of baffle 803 engages alignment slot 802 in gun body 801. Alignment key 805 on top end of baffle 803 engages alignment slot 806 on bottom end fitting 807. In this example, that arrangement aligns perforating charges 270 to scallops 131. In this example, an alternate deto transfer puck design is illustrated where the detonating cord 260 is parallel to but radially displaced from the detonator 809.

Figure 41:
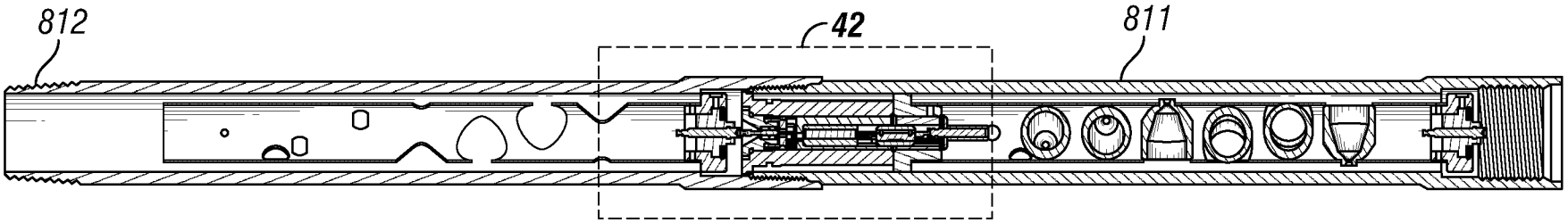
FIG. 41 is a cross-sectional view of an example embodiment of a perforating gun system.
Figure 42:
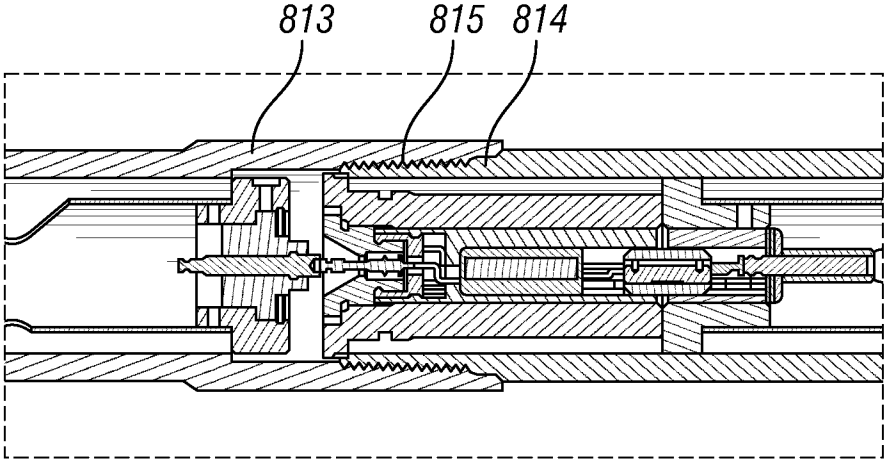
FIG. 42 is a cross-sectional view of the male end of one perforating gun mated to the female end of another perforating gun in the example embodiment of a perforating gun system shown in FIG. 41.

FIGS. 41 and 42 show cross-sectional views of another example embodiment of a perforating gun system using a swaged up box end of the gun and a sealing wedge thread, such as Hunting's SEAL-LOCK or WEDGE-LOCK. In this example, box end 813 of perforating gun 811 is swaged up from its original diameter. In this example, box end 813 and pin end 812 have corresponding premium self-sealing wedge threads. The use of self sealing threads obviates the need for o-rings between perforating gun bodies.

FIGS. 43 and 44 show cross-sectional views of another example embodiment of a perforating gun system using a friction welded fitting to form the pin end of the gun body. In this example, a fitting 823 is friction welded on to a tube 822 to form a perforating gun body.

Figure 22:
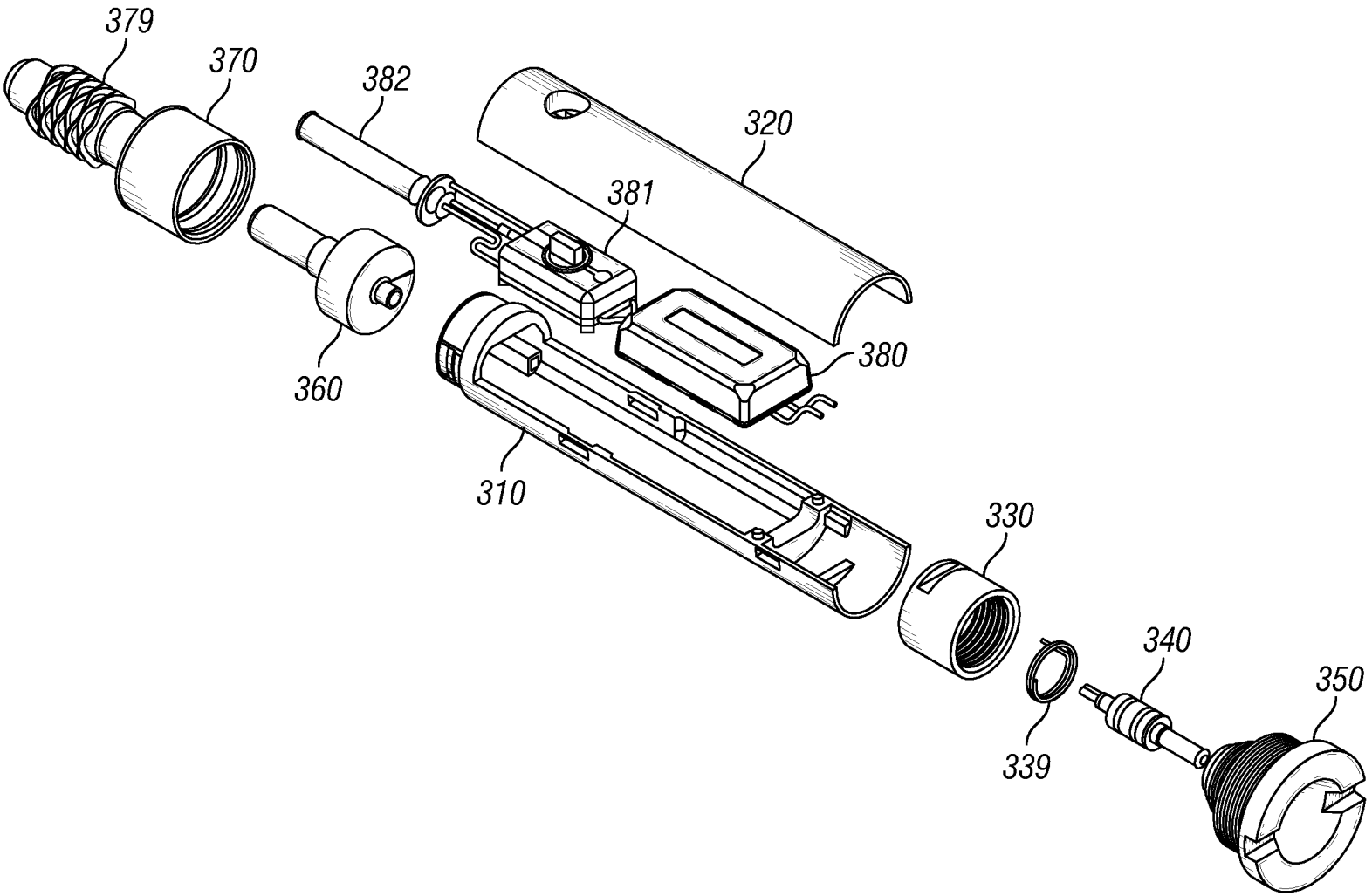
FIG. 22 is an exploded perspective view of an example embodiment of a cartridge assembly.
Figure 23B:
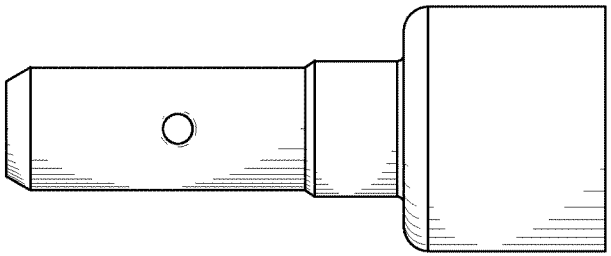
FIG. 23B is a side view of an example embodiment of a cartridge end cap of the cartridge shown in FIG. 22.
Figure 23E:
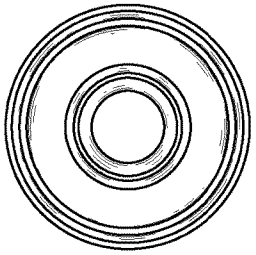
FIG. 23E is an end view of an example embodiment of a cartridge end cap of the cartridge shown in FIG. 22.
Figure 23D:
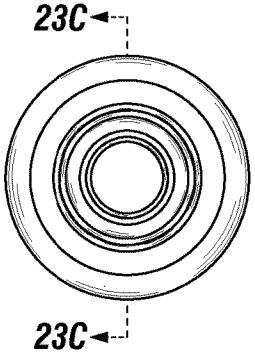
FIG. 23D is an end view of an example embodiment of a cartridge end cap of the cartridge shown in FIG. 22.

FIG. 22 provides an exploded perspective view of an example embodiment of cartridge assembly 300. This embodiment of cartridge assembly 300 includes cartridge end cap 370, contact wave spring 379, deto boot 360, detonator 382, cartridge bottom 310, cartridge top 320, shunt 381, switch module 380, grounding cap 330, ground spring 339, bulkhead feed through assembly 340, and bulkhead retainer 350.

Deto boot 360 holds the detonator centered in place in the cartridge end cap. In this example, the deto boot is made out of a resilient material such as silicone. Deto boot 360 also resiliently biases ring terminal 383 against cartridge end cap 370.

Detonator 382 could be any type of detonator or igniter such as a resistorized electric detonator, an EFI, or an EBW.

Detonator 382 is connected by conductors to shunt 381, which is connected by conductors to switch module 380. Detonator 382 could be replaced by any other initiator as appropriate. Shunt 381 is a manual switch that electrically disables the detonator until manually switched on. This allows safe transport of the complete cartridge assembly. Shunt 381 may not be necessary in all embodiments depending on inherent safety of the switch 380 and detonator 382 used. Switch unit 380 preferably includes an electronic switch that can safely and accurately activate specific downhole tools in response to electrical signals from the surface, such as the ControlFire product from Hunting Titan. The positive control enabled by the tool check and confirmation of switch location prior to perforating of such systems significantly improves accuracy and safety in perforating operations. However, switch unit 380 could be any electric or electronic switch. Shunt 381 is connected to ground through ring terminal 383 and cartridge end cap 370.

FIGS. 23A, 23B, 23C, 23D, and 23E provide various views of an example embodiment of cartridge end cap 370. End cap 370 has a first side wall 371, a second side wall 372, a detonation aperture 373, and an open end 375. First side wall 371 has a larger average internal diameter than second side wall 372. First side wall 371 includes a retention groove 374 in its inner surface. Retention groove 374 fits locking fingers 313 on cartridge bottom 310 to affix cartridge end cap 370 to cartridge bottom 310. In this example, cartridge end cap is made of metal to act as a portion of the electrical communication circuit. Alternatively, cartridge end cap could be equipped with threads or screw holes for attachment to corresponding features on cartridge bottom 310 rather than retention groove 374.

Figure 24:
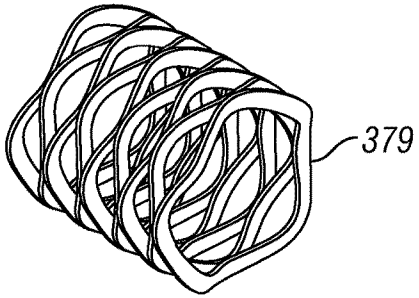
FIG. 24 is a perspective view of an example embodiment of a contact spring of the cartridge shown in FIG. 22.
Figure 23A:
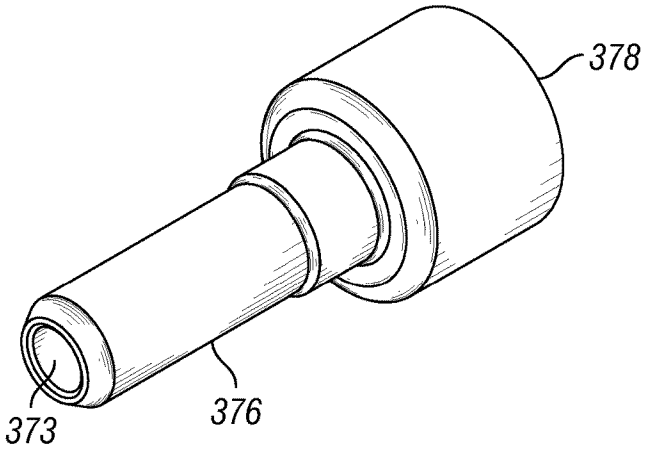
FIG. 23A is a perspective view of an example embodiment of a cartridge end cap of the cartridge shown in FIG. 22.
Figure 23C:
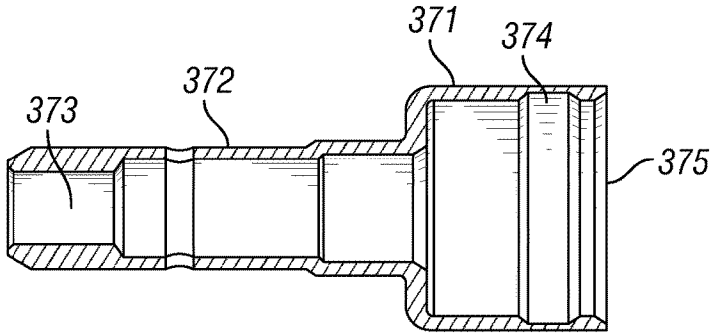
FIG. 23C is a cross-sectional view of an example embodiment of a cartridge end cap of the cartridge shown in FIG. 22.
Figure 25B:
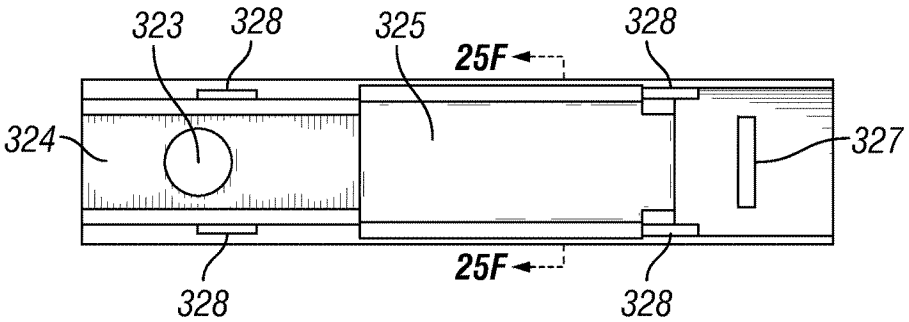
FIG. 25B is a top view of an example embodiment of a plastic cartridge body top of the cartridge shown in FIG. 22.
Figure 25C:
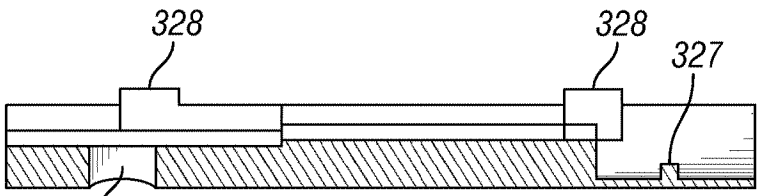
FIG. 25C is a cross-sectional view of an example embodiment of a plastic cartridge body top of the cartridge shown in FIG. 22.
Figure 25F:
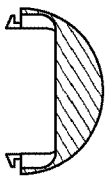
FIG. 25F is a cross-sectional view of an example embodiment of a plastic cartridge body top of the cartridge shown in FIG. 22.
Figure 25E:
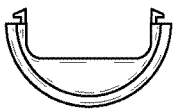
FIG. 25E is an end view of an example embodiment of a plastic cartridge body top of the cartridge shown in FIG. 22.
Figure 25A:
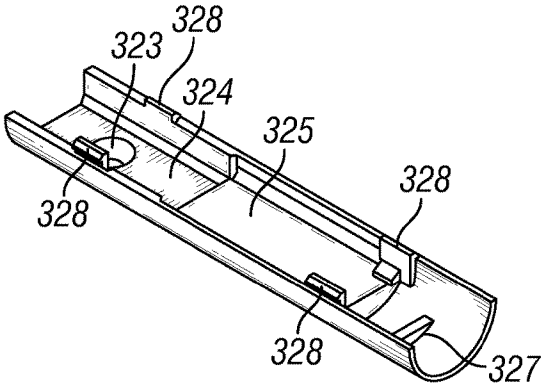
FIG. 25A is a perspective view of an example embodiment of a plastic cartridge body top of the cartridge shown in FIG. 22.
Figure 25D:
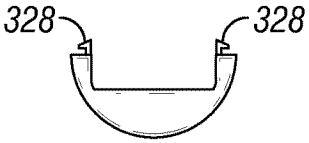
FIG. 25D is an end view of an example embodiment of a plastic cartridge body top of the cartridge shown in FIG. 22.
Figure 26A:
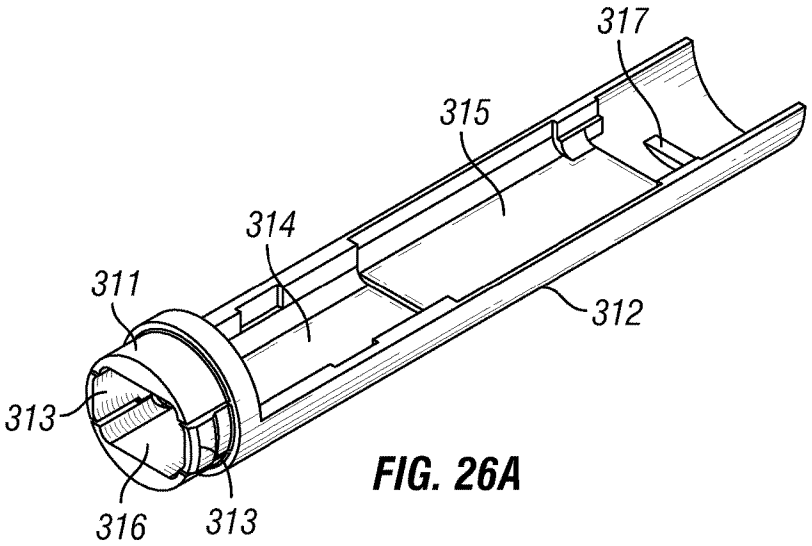
FIG. 26A is a perspective view of an example embodiment of a plastic cartridge body bottom of the cartridge shown in FIG. 22.
Figure 26E:
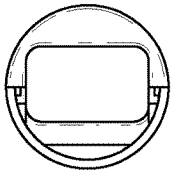
FIG. 26E is an end view of an example embodiment of a plastic cartridge body bottom of the cartridge shown in FIG. 22.
Figure 26D:
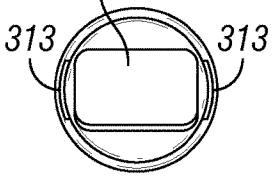
FIG. 26D is an end view of an example embodiment of a plastic cartridge body bottom of the cartridge shown in FIG. 22.
Figure 26G:
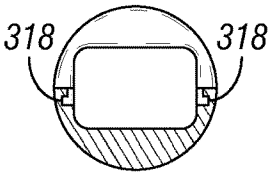
FIG. 26G is a cross-sectional view of an example embodiment of a plastic cartridge body bottom of the cartridge shown in FIG. 22.
Figure 26F:
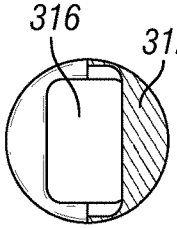
FIG. 26F is a cross-sectional view of an example embodiment of a plastic cartridge body bottom of the cartridge shown in FIG. 22.
Figure 26B:
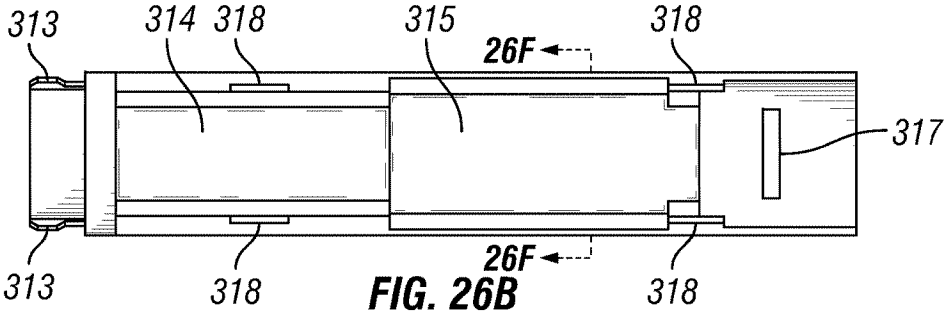
FIG. 26B is a top view of an example embodiment of a plastic cartridge body bottom of the cartridge shown in FIG. 22.
Figure 26C:
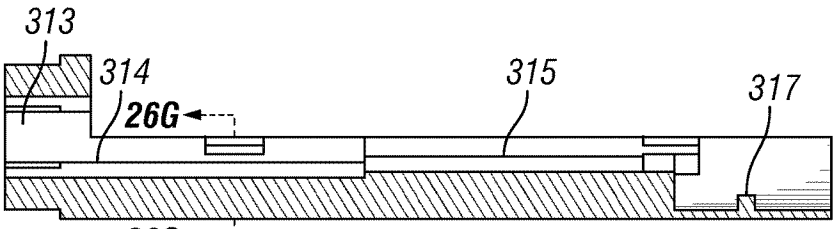
FIG. 26C is a cross-sectional view of an example embodiment of a plastic cartridge body bottom of the cartridge shown in FIG. 22.
Figure 27A:
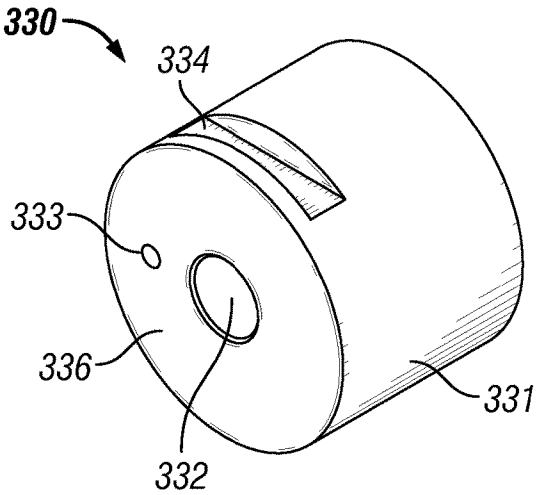
FIG. 27A is a perspective view of an example embodiment of a grounding cap of the cartridge shown in FIG. 22.
Figure 27B:
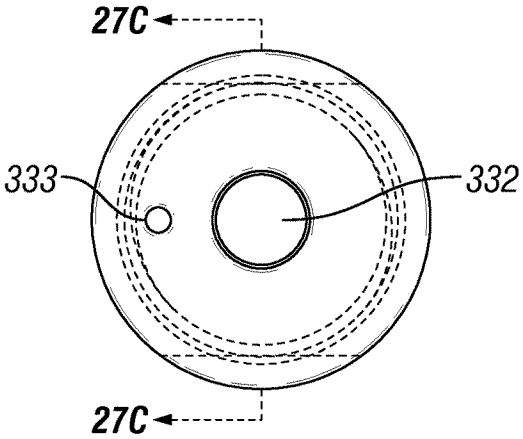
FIG. 27B is an end view of an example embodiment of a grounding cap of the cartridge shown in FIG. 22.
Figure 27C:
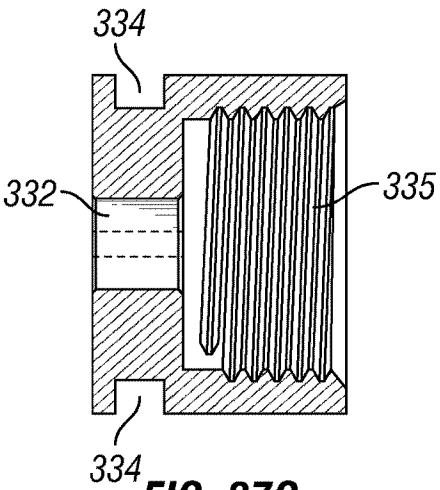
FIG. 27C is a cross-sectional view of an example embodiment of a grounding cap of the cartridge shown in FIG. 22.
Figure 27D:
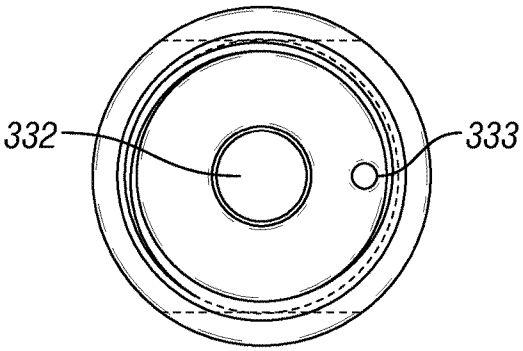
FIG. 27D is an end view of an example embodiment of a grounding cap of the cartridge shown in FIG. 22.

FIG. 24 shows a perspective view of an example contact wave spring 379 for cartridge assembly 300. Contact wave spring 379 is made of conductive material so that it can act as a portion of the electrical communication circuit. Contact wave spring 379 provides a biased electrical connection between deto transfer puck 240 and cartridge end cap 370. This biased electrical connection maintains electrical contact despite variations in manufacturing and assembly tolerances.

FIGS. 26A, 26B, 26C, 26D, 26E, and 26F provide various views of an example embodiment of cartridge bottom 310. Cartridge bottom 310 has a substantially circular top end 311 and a substantially semi-circular side wall 312. Top end 311 has a detonator aperture 316 to allow conductors to connect the detonator 382 and the shunt 381. Top end 312 has two resilient retainer tabs 313. Retainer tabs 313 can resiliently flex inward and back to engage retention groove 374 in end cap 370 to affix end cap 370 to cartridge bottom 310. Side wall 312 has flat internal portions 314 and 315 adapted to hold shunt 381 and switch 380 respectively. Cartridge bottom 310 has an engagement tab 317 to engage groove 334 on grounding cap 330. Side wall 312 has locking slots 318 to engage corresponding locking tabs on cartridge top 320 to snap cartridge top 320 and cartridge bottom 310 together. In this example, cartridge bottom 310 is made of a plastic material.

FIGS. 25A, 25B, 25C, 25D, and 25E provide various views of an example embodiment of cartridge top 320.

Cartridge top 310 has a substantially semi-circular side wall 321 with shunt window 323 through it. Shunt window 323 provide access to actuate shunt switch once the cartridge 300 is assembled. Side wall 321 has flat internal portions 324 and 325 adapted to hold shunt 381 and switch 380 respectively. Cartridge top 320 has an engagement tab 327 to engage groove 334 on grounding cap 330. Side wall 321 has locking tabs 328 to engage corresponding locking slots 318 on cartridge bottom 310 to snap cartridge top 320 and cartridge bottom 310 together. In this example, cartridge top 320 is made of a plastic material.

Cartridge bottom 310 and cartridge top 320 could be made in virtually any other shape. Although the round cartridge shape is described in these examples, the cartridge 300 could be formed with a square, rectangular, hexagonal, or any other cross-section shape.

Figure 28:
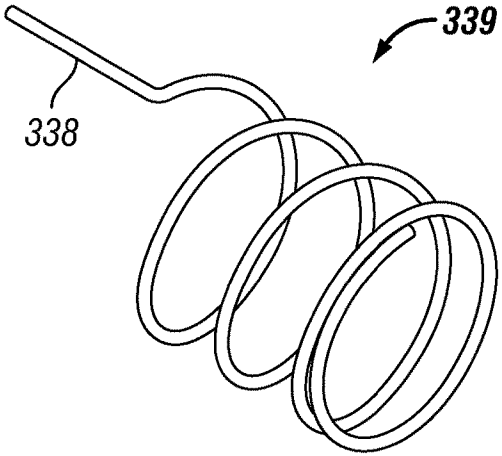
FIG. 28 is a perspective view of an example embodiment of a ground spring of the cartridge shown in FIG. 22.

FIGS. 27A, 27B, 27C, and 27D provide various views of an example embodiment of a ground cap 330. Ground cap 330 has a generally cylindrical shape with an outer surface 331 and a top surface 336, a feed through aperture 332, a ground spring aperture 333, and a threaded internal cavity 335. Ground cap 330 also has engagement slots 334 corresponding to engagement tabs 318 and 328 on cartridge bottom 310 and cartridge top 320 respectively. Threaded internal cavity 335 corresponds to and affixes to first threaded portion 356 of bulkhead retainer 350. Feed through aperture 332 is adapted to pass through the top end of bulkhead feed through assembly 340. Ground spring aperture 333 is adapted to pass through the tail end 338 of ground spring 339. FIG. 28 shows a perspective view of ground spring 339.

FIG. 28 provides a perspective view of ground spring 339. Ground spring 339 is a coil spring with a tail end 338. Ground spring 339 is captured between ground cap 330 and bulkhead retainer 350. Tail end 338 of ground spring 339 extends through ground spring aperture 333 of ground cap 330. Tail end 338 is attached to a ground conductor from switch 380 to complete the ground side of the communications circuit from switch 380.

Figure 29A:
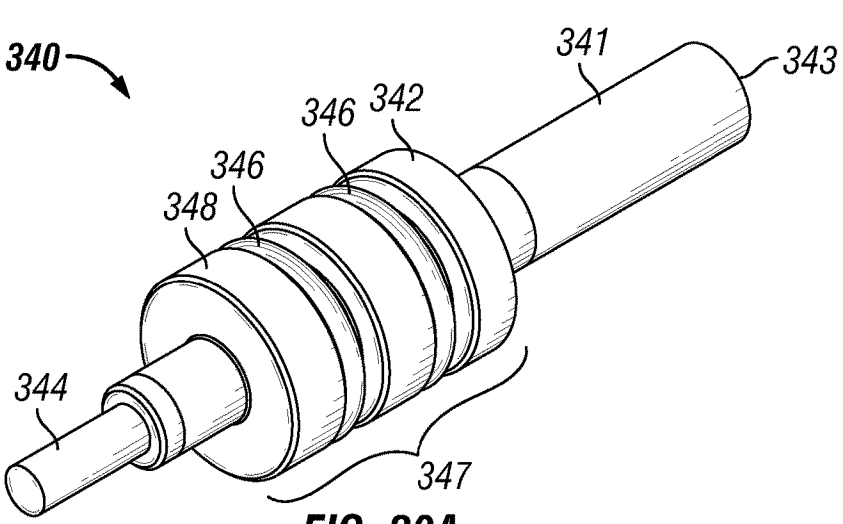
FIG. 29A is a perspective view of an example embodiment of a feed through pin assembly of the cartridge shown in FIG. 22.
Figure 29C:
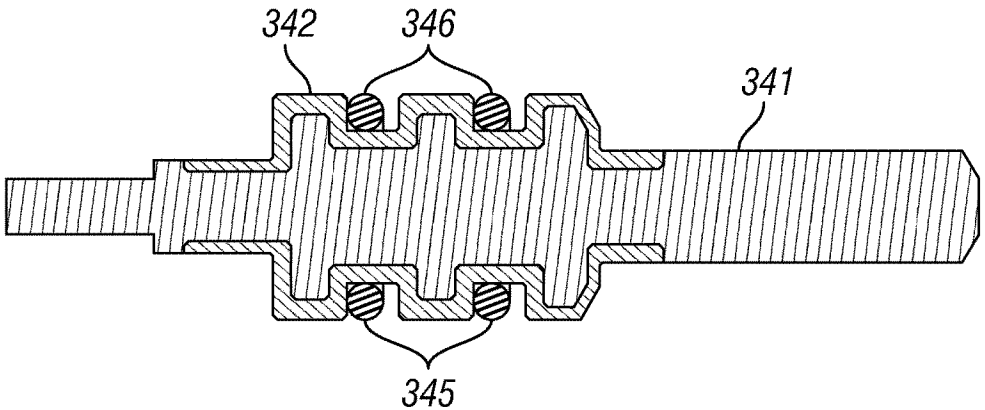
FIG. 29C is a cross-sectional view of an example embodiment of feed through pin assembly of the cartridge shown in FIG. 22.
Figure 29B:
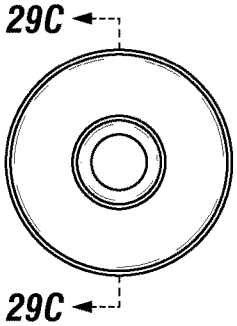
FIG. 29B is an end view of an example embodiment of a feed through pin assembly of the cartridge shown in FIG. 22.
Figure 30C:
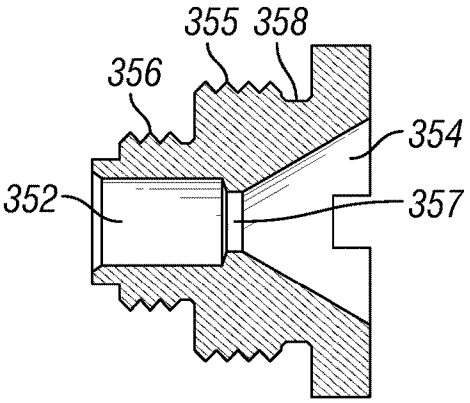
FIG. 30C is a cross-sectional view of an example embodiment of a bulkhead retainer of the cartridge shown in FIG. 22.
Figure 30B:
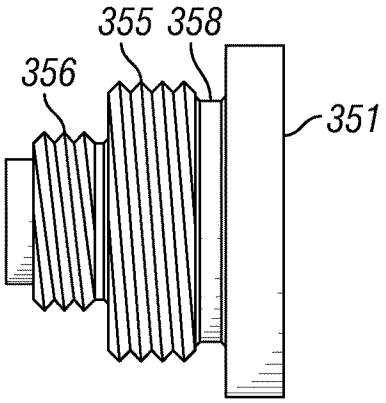
FIG. 30B is an end view of an example embodiment of a bulkhead retainer of the cartridge shown in FIG. 22.
Figure 30A:
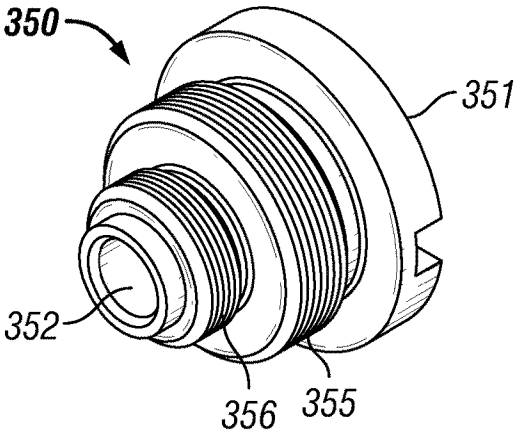
FIG. 30A is a perspective view of an example embodiment of a bulkhead retainer of the cartridge shown in FIG. 22.
Figure 30E:
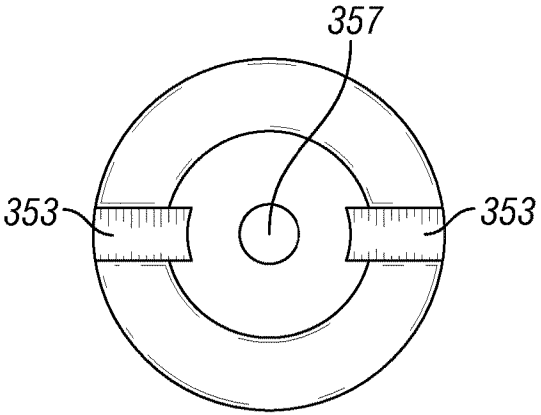
FIG. 30E is an end view of an example embodiment of a bulkhead retainer of the cartridge shown in FIG. 22.
Figure 30D:
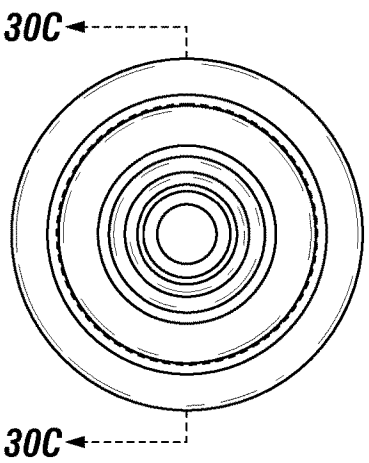
FIG. 30D is an end view of an example embodiment of a bulkhead retainer of the cartridge shown in FIG. 22.

FIGS. 29A, 29B, and 29C provide various views of an example embodiment of a feed through pin assembly 340. Feed through pin assembly 340 has a conductive core 341 with lower portion 343 and upper portion 344. Feed through pin assembly 340 has a central section 347 with a larger diameter that upper portion 344 and lower portion 344. Central section 344 has an electrical insulator 342 around its circumference to insulate conductive core 341 from bulkhead retainer 350. Insulation 342 extends down an upper surface 348 of central section 347 and a portion of upper portion 344. This insulates brass core 341 from ground spring 339 and grounding cap 330. This allows feed through pin assembly 340 to act as part of one side of the communications circuit while pressure bulkhead 350 and ground spring 339 act as part of the other side. Central section 347 has two o-ring grooves 345 housing o-rings 346. This provides a fluid pressure seal between feed through pin assembly 340 and bulkhead retainer 350.

FIGS. 30A, 30B, 30C, 30D, and 30E provide various views of an example embodiment of a bulkhead retainer 350. Bulkhead retainer 350 has a cap portion 351, a first threaded portion 356 and a second threaded portion 355. The external diameter of second threaded portion 355 is greater than the external diameter of first threaded portion 356. Second threaded portion 355 corresponds to internal threads 432 of baffle 400 and allows bulkhead retainer 350 to be screwed into baffle 400. First threaded portion 356 corresponds to threaded cavity 335 of ground cap 330. Bulkhead retainer 350 has a first bore 352, an aperture 357, and a second bore 354. First bore 352 is adapted to accommodate central section 347 of feed through pin assembly 340. Aperture 357 is adapted to pass through lower portion 344 of feed through pin assembly 340. Second bore 354 is conically shaped to ease assembly of two perforating guns together. The conical shape directs feed through contact pin 215 to contact lower portion 343 of feed through pin assembly 340. Bulkhead retainer 350 includes o-ring groove 358 housing an o-ring to provide a fluid pressure seal between bulkhead retainer 350 and baffle 400. Cap portion 351 has slots 353 to provide a tool surface to aid in assembly and disassembly of the perforating gun system. In this example, the bulkhead retainer is made of a conductive material so that it can function as a portion of the ground path of the communications circuit.

Figure 31:
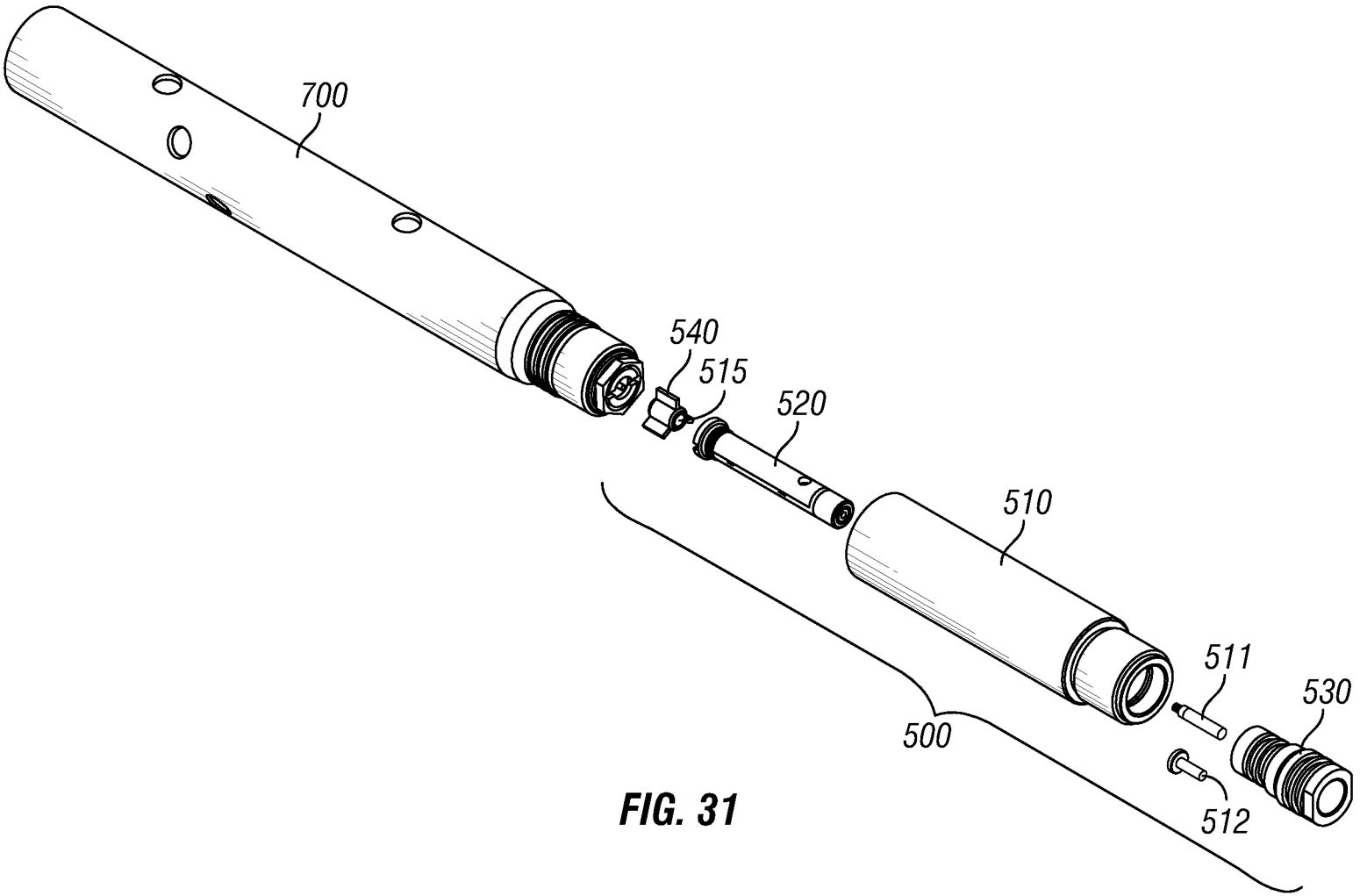
FIG. 31 is an exploded perspective view of an example embodiment of a plug and shoot adapter assembly.

FIG. 31 provides an exploded perspective view of an example embodiment of a plug and shoot adapter 500 and perforating gun 700. Plug and shoot adapter 500 includes plug and shoot feed through 540, contact plunger screw 515, plug and shoot cartridge assembly 520, plug and shoot body 510, igniter 511, and igniter holder 530. Plug shoot adapter 500 links a setting tool to perforating gun 700. Traditionally, this has been accomplished using two components, a plug and shoot adapter and a firing head.

Figure 32A:
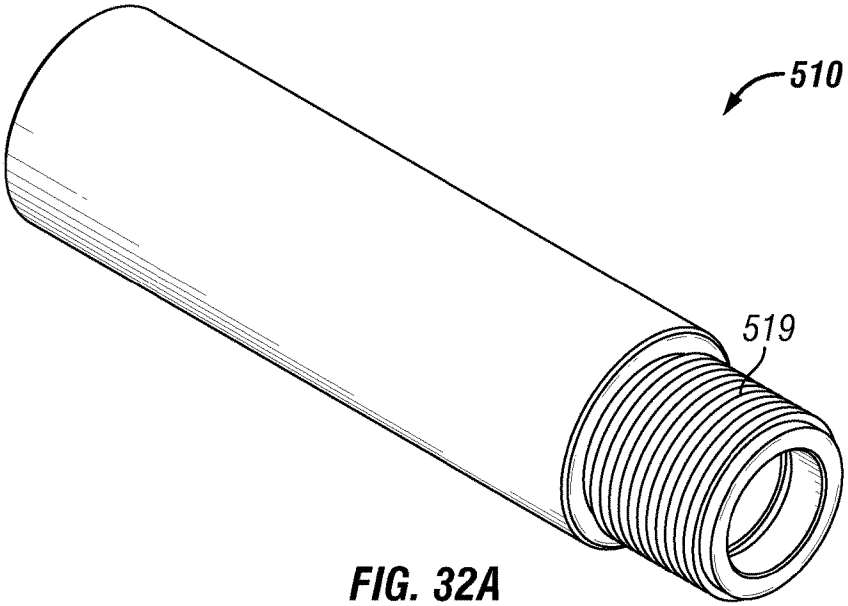
FIG. 32A is a perspective view of an example embodiment of a plug and shoot body of the plug and shoot adapter assembly shown in FIG. 31.
Figure 32C:
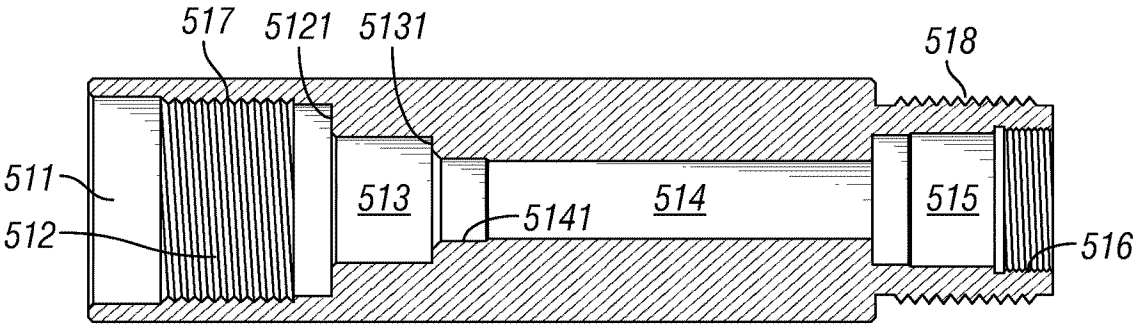
FIG. 32C is a cross-sectional view of an example embodiment of a plug and shoot body of the plug and shoot adapter assembly shown in FIG. 31.
Figure 32B:
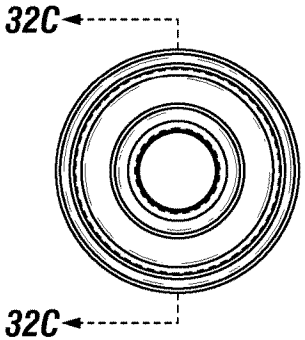
FIG. 32B is an end view of an example embodiment of a plug and shoot body of the plug and shoot adapter assembly shown in FIG. 31.
Figure 33A:
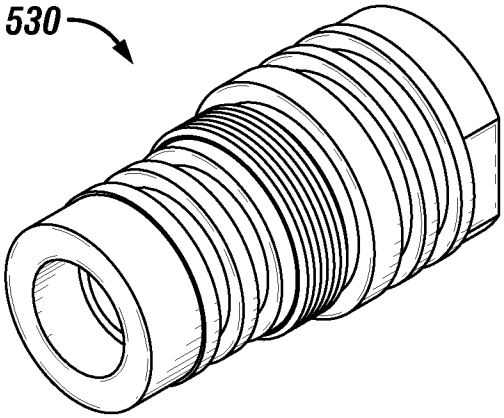
FIG. 33A is a perspective view of an example embodiment of an igniter holder of the plug and shoot adapter assembly shown in FIG. 31.
Figure 33C:
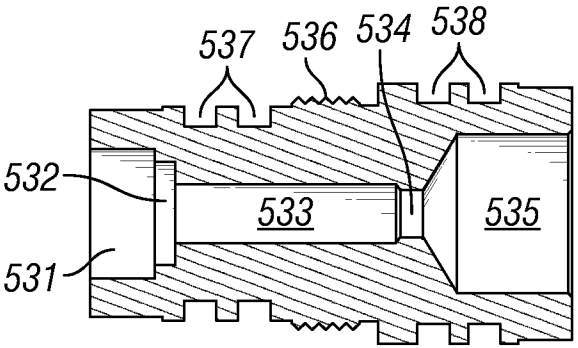
FIG. 33C is a cross-sectional view of an example embodiment of an igniter holder of the plug and shoot adapter assembly shown in FIG. 31.
Figure 33D:
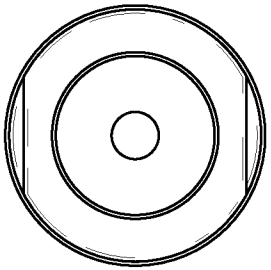
FIG. 33D is an end view of an example embodiment of an igniter holder of the plug and shoot adapter assembly shown in FIG. 31.
Figure 33B:
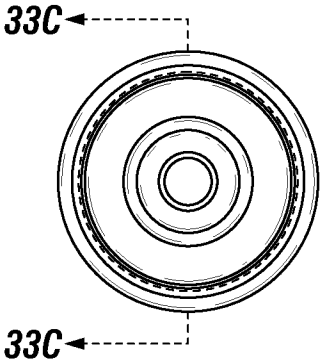
FIG. 33B is an end view of an example embodiment of an igniter holder of the plug and shoot adapter assembly shown in FIG. 31.

FIGS. 32A, 32B, and 32C provide various views of plug shoot body 510. Plug shoot body has a substantially cylindrical shape with a narrowed bottom end 519 having male threads 518. From top to bottom end, plug and shoot body 510 has a first bore 511, a second bore 512, a third bore 513, a fourth bore 514, and a fifth bore 515. Fourth bore 514 is smaller in diameter than fifth bore 515. Fourth bore 514 is smaller in diameter than third bore 513, which is smaller in diameter than second bore 512, which is smaller in diameter than first more 511. Bottom end threads 518 correspond to and affix to female threads on a setting tool. Second bore 512 has internal threads 517 that correspond to and affix to male threads 111 on bottom end of gun body 130. Plug and shoot body 510 has a shoulder 5121 at the transition from second bore 512 to third bore 513. Third bore 513 is adapted to hold plug and shoot feed through 540. Plug and shoot body 510 has a shoulder 5131 at the transition from third bore 513 to fourth bore 514. Fourth bore 514 is adapted to hold plug and shoot cartridge 520. Fourth bore 514 has internal threads 5141 that correspond to and affix to male threads 355 on bulkhead retainer 350 to hold plug and shoot adapter 520. Fifth bore 515 has internal threads 516 that correspond to and affix to male threads 536 on igniter holder 530. In this example, plug and shoot body 510 is made of a conductive material so that it can act as a portion of the ground conductor side of the communications circuit.

Figure 34B:
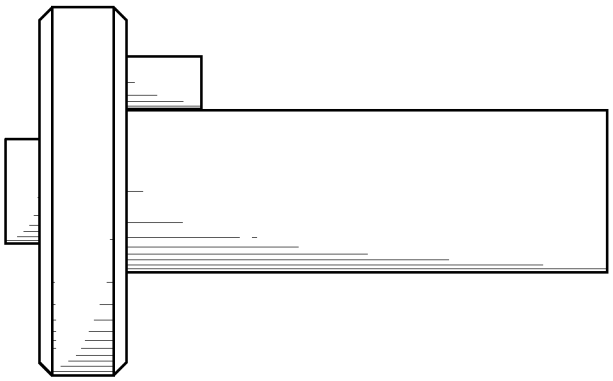
FIG. 34B is a side view of an example embodiment of an igniter of the plug and shoot adapter assembly shown in FIG. 31.
Figure 34A:
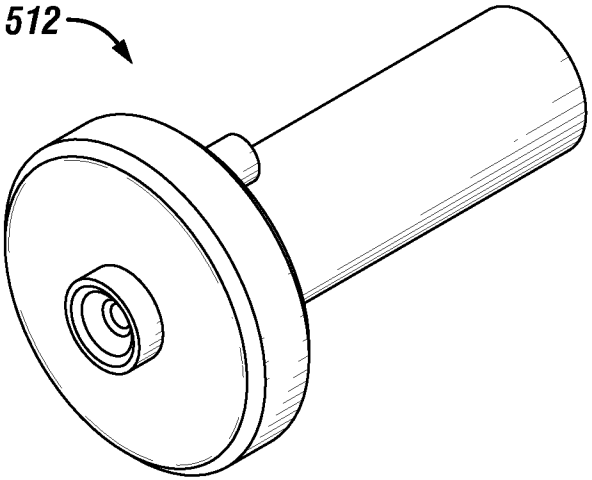
FIG. 34A is a perspective view of an example embodiment of an igniter of the plug and shoot adapter assembly shown in FIG. 31.
Figure 35A:
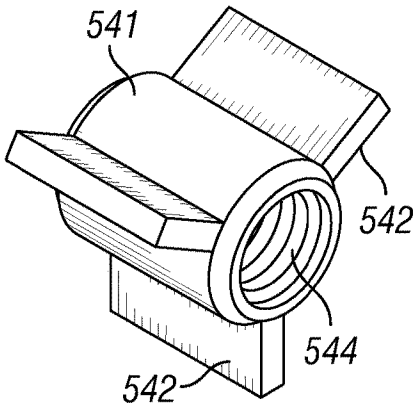
FIG. 35A is a perspective view of an example embodiment of a plug and shoot feed through of the plug and shoot adapter assembly shown in FIG. 31.
Figure 35B:
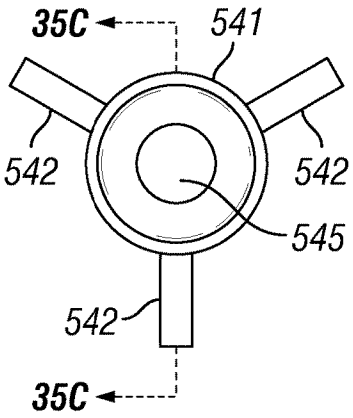
FIG. 35B is an end view of an example embodiment of a plug and shoot feed through of the plug and shoot adapter assembly shown in FIG. 31.
Figure 35C:
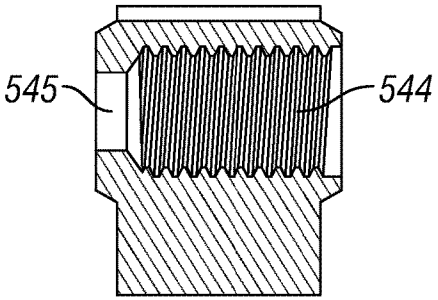
FIG. 35C is a cross-sectional view of an example embodiment of a plug and shoot feed through of the plug and shoot adapter assembly shown in FIG. 31.
Figure 35D:
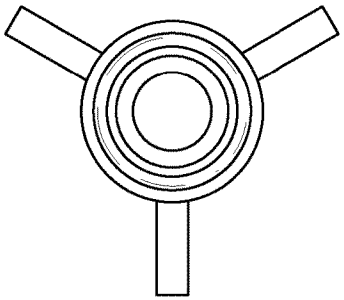
FIG. 35D is an end view of an example embodiment of a plug and shoot feed through of the plug and shoot adapter assembly shown in FIG. 31.

FIGS. 33A, 33B, 33C, and 33D provide various views of an example embodiment of an igniter holder 530. Igniter holder 530 has a substantially circular shape, a first bore 531, a second bore 532, a third bore 533, an aperture 534, and a fourth bore 535. Third bore 533 has a smaller diameter than fourth bore 535 and a larger diameter than aperture 534. Third bore 533 has a smaller diameter than second bore 532, which has a smaller bore than first bore 531. First bore 531 is adapted to accept bottom end of plug and shoot cartridge 520. Third bore 533 is adapted to hold igniter 511 or 512. Second bore 532 is adapted to hold the rim of a Baker style igniter 512. Igniter holder 530 has external threads 536 that correspond to and affix to internal threads 516 in plug and shoot body 510. Igniter holder 530 includes o-ring grooves 537 housing o-rings to provide a fluid pressure seal between plug and shoot body 510 and igniter holder 530. Igniter holder 530 includes o-ring grooves 538 housing o-rings to provide a fluid pressure seal between igniter holder 530 and a setting tool. FIGS. 34A and 34B provide various views of an example Baker style igniter.

FIGS. 35A, 35B, 35C, and 35D provide various views of an example embodiment of a plug and shoot feed through 540. Plug and shoot feed through 540 has a substantially cylindrical body 541, alignment fins 542, threaded bore 544, and aperture 545. Threaded bore 544 accepts contact plunger screw 515. Contact plunger screw 515 provides electrical conductivity from feed through pin assembly 340 of cartridge assembly 300 to feed through pin assembly 340 of plug and shoot cartridge 520. Plug and shoot feed through 540 insulates contact plunger screw 515 from plug and shoot body 510, bulkhead retainer 350 of cartridge 300, and bulkhead retainer 350 of plug and shoot cartridge 520. Fins 542 keep contact plunger screw 515 axially centered in plug and shoot body 510. Aperture 545 allows contact plunger screw 515 to contact feed through pin assembly 340 of cartridge assembly 300.

Figure 36:
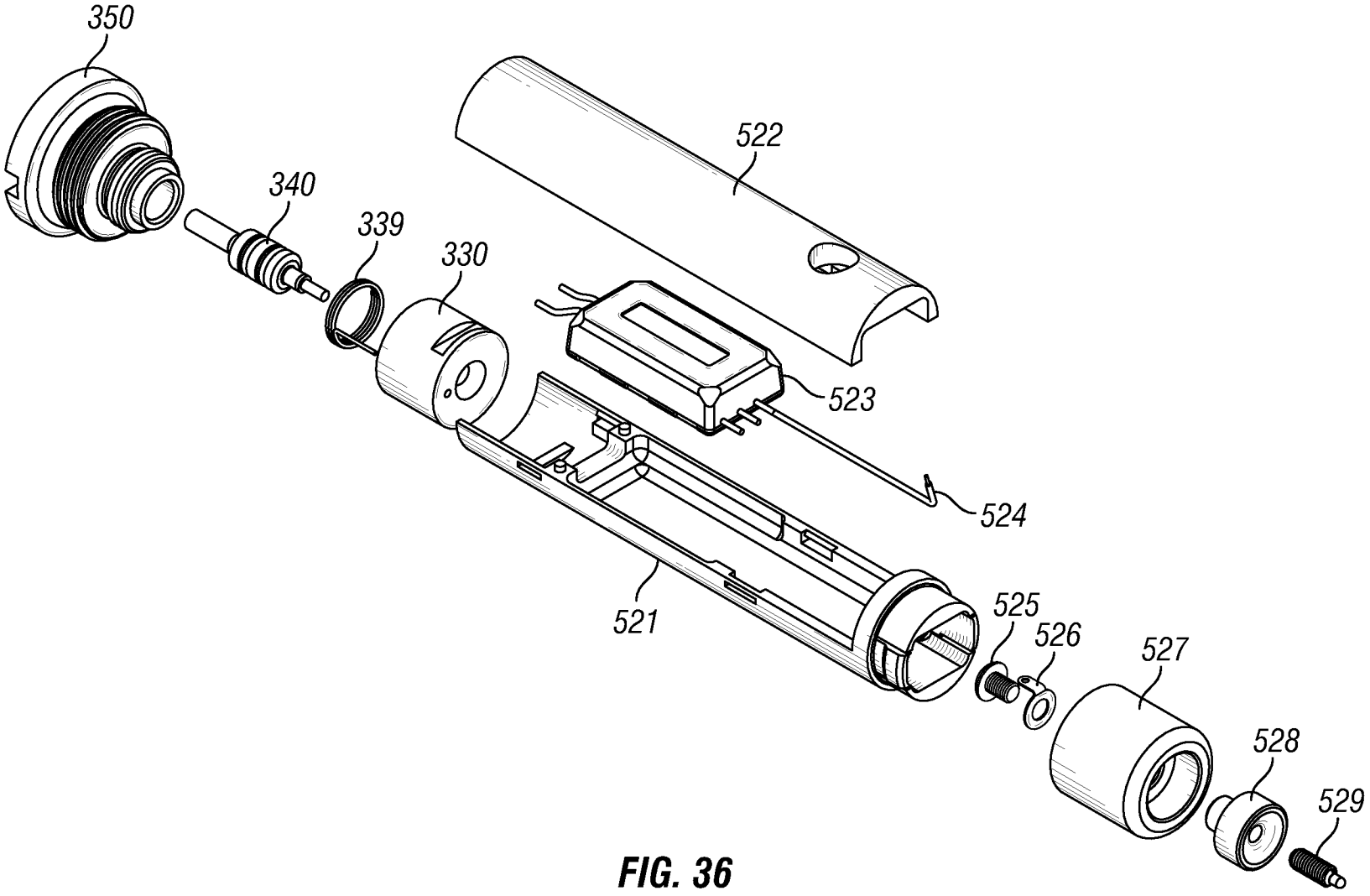
FIG. 36 is an exploded perspective view of an example embodiment of a plug and shoot cartridge assembly.

FIG. 36 is an exploded perspective view of an example embodiment of a plug and shoot cartridge assembly 520. Plug and shoot cartridge assembly 520 shares a number of components and has similar assembly steps and function to cartridge assembly 300. Plug and shoot cartridge assembly 520 includes bulkhead retainer 350, bulkhead feed through assembly 340, ground spring 339, and ground cap 330 that are shared with and assemble the same in cartridge 300. Plug and shoot cartridge 520 includes plug and shoot cartridge bottom 521 and top 522. Plug and shoot cartridge top 522 and bottom 521 are the same as cartridge top 320 and bottom 310 other than reduced length. Plug and shoot cartridge 520 has a switch 523 with a feed through wire 524. Plug and short cartridge 520 includes screw 525, solder lug 526, cartridge end cap 527, contact receptacle 528, and contact plunger screw 529. Cartridge cap 527 has an internal retention groove that engages retention tabs on cartridge bottom 521. Cartridge cap 527 has an aperture so that screw 525 can pass through solder lug 526 and cartridge end cap 527 and screw into contact receptacle 528. Contact plunger screw 529 then threads into contact receptacle 528, completing the conductive path from switch 523, to feed through wire 524, to ground lug 526, to contact receptacle 528, to contact plunger screw 529, to igniter 511.

Figure 37A:
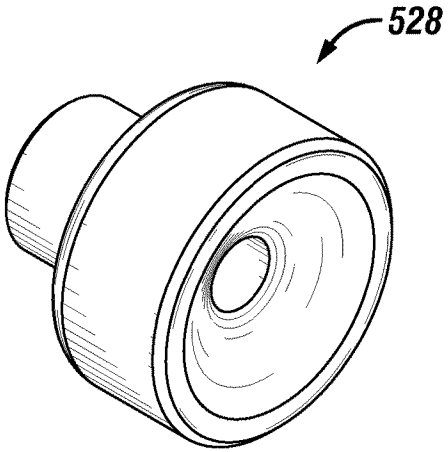
FIG. 37A is a perspective view of an example embodiment of a plug and shoot feed through receptacle of the plug and shoot adapter assembly shown in FIG. 31.
Figure 37C:
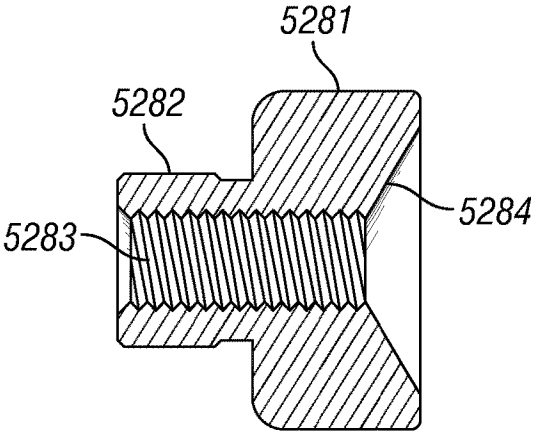
FIG. 37C is a cross-sectional view of an example embodiment of a plug and shoot feed through receptacle of the plug and shoot adapter assembly shown in FIG. 31.
Figure 37B:
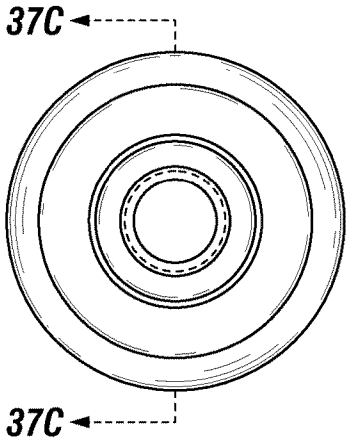
FIG. 37B is an end view of an example embodiment of a plug and shoot feed through receptacle of the plug and shoot adapter assembly shown in FIG. 31.

FIGS. 37A, 37B, and 37C show a variety of views of an example embodiment of a contact receptacle 528. Contact receptacle 528 has a first substantially cylindrical portion 5282 and a second substantially cylindrical portion 5281 with a larger diameter than first cylindrical portion 5282. Contact receptacle 528 has a threaded bore 5283 adapted to receive and affix to screw 525. Contact receptacle 528 has a conical depression 5284 in second portion 5281 to guide initiator 511 to contact plunger screw 529 and allow the use of different styles of igniters with a single tool.

Figure 38:
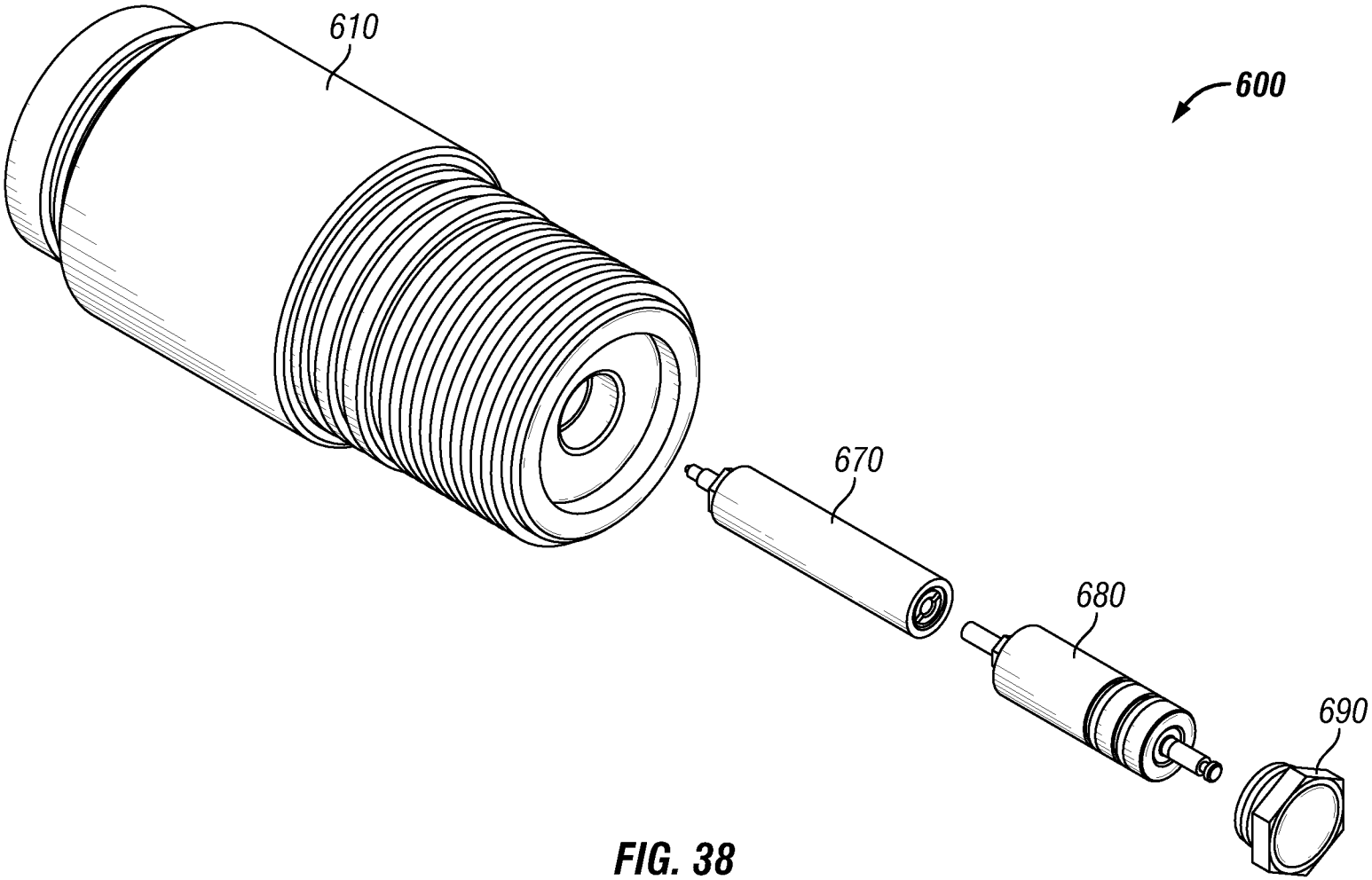
FIG. 38 is an exploded perspective view of an example embodiment of a top gun adapter sub assembly.

FIG. 38 provides an exploded perspective view of an example embodiment of a top gun adapter sub assembly 600. Top gun adapter assembly 600 has a sub body 610, a plunger cartridge 670, a feed through assembly 680 and a retainer nut 690. Top gun adapter sub assembly 600 connects the top of a perforating gun to a casing collar locator both mechanically and electrically.

In one example method of assembling a perforating gun system a shaped charge loading tube assembly 200, gun body 130, and baffle 400 are received together. Shaped charges 270, detonating cord 260, and cartridge 300 are received. Baffle 400 is removed from gun body 130. Loading tube 200 is removed from gun body 130. Loading tube 200 is loaded with perforating charges 270 and detonating cord 260 and reinserted into gun body 130. Loaded perforating gun 100 can be transported to a well site in this configuration. Next cartridge 300 is inserted into loaded perforating gun 100 to arm perforating gun 100. Finally, the armed perforating gun can be assembled into a tool string with other devices such as collar locators, tub gun subs, plug shoot adapters, setting tools, and plugs.

An example method of manufacturing a perforating gun body includes the following steps: swaging down a first end to a smaller diameter, cutting external threads and o-ring grooves into that first end and cutting corresponding internal threads and o-ring sealing surface into the other end. Alternatively, first end is swaged up to a larger diameter, and then internal threads and o-ring sealing surface cut into first end and corresponding external threads and o-ring grooves cut into the other end. In swaging the diameter of the gun body up or down, the wall thickness of the tubular material remains substantially the same.

Another example method of manufacturing a perforating gun body includes the following steps: providing a tube of substantially constant diameter, cutting internal self-sealing threads, such as Hunting's SEAL-LOCK or WEDGE-LOCK are in a first end of the gun body, and cutting corresponding external self-sealing threads are cut in a second end of the gun body. Alternatively, non-sealing threads and o-ring grooves can be cut into the gun body.

Another example method of manufacturing a perforating gun body includes the following steps: welding a fitting on to the end of a tube, then cutting external threads and o-ring grooves into that fitting and cutting corresponding internal threads and o-ring sealing surface into the other end of the tube. Alternatively, internal threads and o-ring sealing surface are cut into the fitting and corresponding external threads and o-ring grooves cut into the other end of the tube.

An example method of assembling and loading a shaped charge loading tube assembly includes the following steps: cutting charge holes 281 and retaining holes 282 in the shaped charge holder 280; forming the feed through puck 218 with a central bore 2181, an alignment slot 2182 or tab, and retainer holes 2183; forming the deto transfer puck 240 with an internal bore 242 for the detonator and an internal bore 249 adapted to receive detonating cord; forming top insulating cap 210 with an aperture 2103, internal alignment slot or tab 2106, external alignment slot or tab 211, and engagement ridge 2107; forming bottom insulating cap 230 with an aperture 236 and an engagement ridge 234; inserting feed through contact pin 215 compression spring 217 and retainer 214 into feed through puck 218; snapping upper insulating cap 210 on to feed through puck 218; snapping bottom insulating cap 230 onto deto transfer puck 240; attaching feed through puck 218 and deto transfer puck 240 to charge holder 280 with screws 219; attaching retainers 250 to shaped charges 270; placing detonating cord 260 proximate to retaining hole 282; inserting shaped charge 270 through charge hole 281; twisting shaped charge 270 so that retainer 250 engages charge holder 280 and detonating cord 260.

An example method of assembling a cartridge 300 includes the following steps: forming cartridge bottom 310 with a substantially circular top end 311 and a substantially semi-circular side wall 312 a detonator aperture 316 two resilient retainer tabs 313 to resiliently engage retention groove 374 in end cap 370, flat internal portions 314 and 315 adapted to hold shunt 381 and switch 380 respectively, an engagement tab 317 to engage groove 334 on grounding cap 330, locking slots 318 to engage corresponding locking tabs on cartridge top 320 to snap cartridge top 320 and cartridge bottom 310 together; forming cartridge top 320 with a substantially semi-circular side wall 321 with shunt window 323 through it, flat internal portions 324 and 325 adapted to hold shunt 381 and switch 380 respectively, an engagement tab 327 to engage groove 334 on grounding cap 330, locking tabs 328 to engage corresponding locking slots 318 on cartridge bottom 310 to snap cartridge top 320 and cartridge bottom 310 together; forming cartridge end cap 370 with a first side wall 371, a second side wall 372, a detonation aperture 373, an open end 375, and a retention groove 374 in its inner surface; forming deto boot 360 of a resilient material; forming grounding cap 330 with Ground cap 330 has a generally cylindrical shape with an outer surface 331 and a top surface 336, a feed through aperture 332, a ground spring aperture 333, a threaded internal cavity 335, and engagement slots 334; forming bulkhead feed through assembly 340 with insulating sleeve 342 and conductive core 341; forming pressure seal bulkhead 350 with aperture 357; placing bulkhead feed through assembly into pressure seal bulkhead 350; thread pressure seal bulkhead 350 into grounding cap 330, capturing bulkhead feed through assembly; electrically connecting switch unit 382 to shunt 381 and ground spring 330; electrically connecting detonator 382 and shunt 381; placing detonator 382, shunt 381, switch 380, and grounding cap 330 into cartridge bottom 310; snap cartridge top 320 onto cartridge bottom 310; placing deto boot 360 over detonator 382; placing cartridge end cap 370 onto cartridge bottom end, engaging tabs 313; placing wave spring 379 on cartridge end cap 370; Alternatively, shunt 381 could be omitted and detonator 382 connected directly to, or integral with switch 380.

An example method of perforating includes the following steps: receiving shaped charge loading tube assembly 200, gun body 130, and baffle 400; receiving Shaped charges 270, detonating cord 260, and cartridge 300 containing detonator 382 and switch unit 380; load shaped charge loading tube assembly 300 with shaped charges 270 and detonating cord 260; load shaped charge loading tube assembly into gun body 130; transport loaded perforating gun to well site; insert cartridge 300 containing detonator 382 and switch unit 380 into perforating gun to arm perforating gun; assemble tool string including perforating gun; lower perforating gun into wellbore; detonate detonator 382 to perforate well casing.

An example method of perforating includes the following steps: receiving shaped charge loading tube assembly 200, gun body 130, and baffle 400; receiving Shaped charges 270, detonating cord 260, and cartridge 300 containing detonator 382 and switch unit 380; load shaped charge loading tube assembly 300 with shaped charges 270 and detonating cord 260; load shaped charge loading tube assembly into gun body 130; insert cartridge 300 containing detonator 382 and switch unit 380 into perforating gun to arm perforating gun; transport loaded and armed perforating gun to well site; assemble tool string including perforating gun; lower perforating gun into wellbore; detonate detonator 382 to perforate well casing.

What is claimed is:

1. A perforating gun system comprising:

a first gun body having external threads at a first end, internal threads at a second end, shaped charges arrayed within a loading tube located within, a detonating cord coupled to the shaped charges;

a cartridge inserted in the gun body containing an electrically actuated detonator adjacent to the detonating cord, a shunt, and an electrical switch for selective detonation, wherein the shunt is electrically coupled to the electrical switch, which is further electrically coupled to the detonator, wherein the insertable cartridge can selectively fire the perforating charges in the first gun body, independent of any additional gun body coupled to the first gun body; and a contact wave spring and a deto transfer puck, wherein the contact wave spring is engaged between the insertable cartridge and the deto transfer puck.

2. The perforating gun system of claim 1 wherein the cartridge is adapted to be inserted and removed from the perforating gun as a unit.

3. The perforating gun system of claim 1 further comprising:

a shaped charge loading tube having an upper end and a lower end;

wherein the cartridge has an electrical contact proximate to the detonator; and the lower end of the loading tube has an electrical contact adapted to contact the electrical contact proximate to the detonator.

4. The perforating gun system of claim 1 further comprising:

at least one insulator between the shaped charge loading tube and the gun body.

5. The perforating gun system of claim 4 further comprising:

an upper end fitting on the upper end of the shaped charge loading tube; and a lower end fitting on the lower end of the shaped charge loading tube.

6. The perforating gun system of claim 4 wherein the at least one insulator comprises an insulating fitting on an apex end of a plurality of shaped charges.

7. The perforating gun system of claim 4 wherein the at least one insulator comprises an insulating fitting on an open end of a plurality of shaped charges.

8. The perforating gun system of claim 4 wherein the at least one insulator comprises an insulating sleeve over the shaped charge loading tube.

9. The perforating gun system of claim 4 wherein the cartridge has at least one electrical contact at each end.

10. The perforating gun system of claim 1 wherein the cartridge has at least one electrical contact at each end.

11. The perforating gun system of claim 1 wherein the shunt is a manual switch that electrically disables the detonator until manually switched on.

12. A perforating gun system comprising:

a first gun body having external threads at a first end, internal threads at a second end, shaped charges arrayed within a loading tube located within, a detonating cord coupled to the shaped charges; and a cartridge inserted in the gun body containing an electrically actuated detonator adjacent to the detonating cord, a shunt, wherein the shunt is electrically coupled to the electrical switch, and an electrical switch for selective detonation, a shunt window, wherein the shunt window provides access to actuate the shunt switch, which is further electrically coupled to the detonator, wherein the insertable cartridge can selectively fire the perforating charges in the first gun body, independent of any additional gun body coupled to the first gun body.

13. The perforating gun system of claim 2 wherein the cartridge is adapted to be inserted and removed from the perforating gun as a unit.

14. The perforating gun system of claim 2 further comprising:

a shaped charge loading tube having an upper end and a lower end;

wherein the cartridge has an electrical contact proximate to the detonator; and the lower end of the loading tube has an electrical contact adapted to contact the electrical contact proximate to the detonator.

15. The perforating gun system of claim 2 further comprising:

at least one insulator between the shaped charge loading tube and the gun body.

16. The perforating gun system of claim 15 further comprising:

an upper end fitting on the upper end of the shaped charge loading tube; and a lower end fitting on the lower end of the shaped charge loading tube.

17. The perforating gun system of claim 15 wherein the at least one insulator comprises an insulating fitting on an apex end of a plurality of shaped charges.

18. The perforating gun system of claim 15 wherein the at least one insulator comprises an insulating fitting on an open end of a plurality of shaped charges.

19. The perforating gun system of claim 15 wherein the at least one insulator comprises an insulating sleeve over the shaped charge loading tube.

20. The perforating gun system of claim 15 wherein the cartridge has at least one electrical contact at each end.

21. The perforating gun system of claim 2 wherein the cartridge has at least one electrical contact at each end.

22. The perforating gun system of claim 2 wherein the shunt is a manual switch that electrically disables the detonator until manually switched on.

* * * * *